US009604226B2

(12) United States Patent
Storm

(10) Patent No.: US 9,604,226 B2
(45) Date of Patent: Mar. 28, 2017

(54) PULVERIZER MILL PROTECTION SYSTEM

(71) Applicant: Innovative Combustion Technologies, Inc., Pelham, AL (US)

(72) Inventor: Richard Paul Storm, Hoover, AL (US)

(73) Assignee: Innovative Combustion Technologies, Inc., Pelham, AL (US)

( * ) Notice: Subject to any disclaimer, the term of this patent is extended or adjusted under 35 U.S.C. 154(b) by 0 days.

(21) Appl. No.: 14/966,351

(22) Filed: Dec. 11, 2015

(65) Prior Publication Data

US 2016/0096182 A1 Apr. 7, 2016

Related U.S. Application Data

(63) Continuation-in-part of application No. 14/529,769, filed on Oct. 31, 2014, which is a continuation-in-part (Continued)

(51) Int. Cl.

| | |
|---|---|
| ***B02C 15/00*** | (2006.01) |
| ***B02C 23/04*** | (2006.01) |
| ***A62C 3/00*** | (2006.01) |

(52) U.S. Cl.

CPC ..... *B02C 23/04* (2013.01); *A62C 3/00* (2013.01); *B02C 15/001* (2013.01); *B02C 15/007* (2013.01)

(58) Field of Classification Search

CPC ..... B02C 23/04; B02C 23/08; B02C 23/00; B02C 15/00; B02C 15/001; B02C 15/007; B02C 25/00

(Continued)

(56) References Cited

U.S. PATENT DOCUMENTS 2,749,052 A 6/1956 Romera
3,912,015 A 10/1975 Garbee et al.

(Continued)

FOREIGN PATENT DOCUMENTS

CN 101716540 A 6/2010
EP 107044 A2 5/1984

(Continued)

OTHER PUBLICATIONS

International Search Report for International Application No. PCT/US2013/039107, Aug. 29, 2013.

(Continued)

*Primary Examiner* — Faye Francis
(74) *Attorney, Agent, or Firm* — Ashley Law Firm, P.C.; Stephen S. Ashley, Jr.

(57) ABSTRACT

A system for suppressing and inhibiting fires in coal pulverizer mills can include a fire suppression solution storage tank, a flow control cabinet, an equipment control/pumping enclosure, an air distribution system, and injection piping and nozzles installed at various positions in one or more pulverizer mills. A first set of nozzle assemblies in communication with the fire suppression solution can be positioned in the mill to disperse the suppression solution within the classifier zone of the mill. A second set of nozzle assemblies in communication with the suppression solution can be positioned within the mill to disperse the suppression solution within the grinding zone. A third set of nozzle assemblies can be positioned within the primary air duct of the mill.

20 Claims, 21 Drawing Sheets

Related U.S. Application Data of application No. PCT/US2013/039107, filed on May 1, 2013.

(60) Provisional application No. 61/640,853, filed on May 1, 2012.

(58) Field of Classification Search
USPC ..... 241/31, 41, 57, 117–119, 37.5
See application file for complete search history.

(56) References Cited

U.S. PATENT DOCUMENTS

| | | | | | |
|---|---|---|---|---|---|
| 4,244,529 | A | | 1/1981 | DeGabriele et al. | |
| 4,489,895 | A | * | 12/1984 | Petersen | B02C 15/007 241/119 |
| 4,653,698 | A | | 3/1987 | Cooper et al. | |
| 4,721,258 | A | * | 1/1988 | Dougan | B02C 15/001 241/103 |
| 4,754,932 | A | | 7/1988 | Kmiotek et al. | |
| 4,778,113 | A | | 10/1988 | Jewett et al. | |
| 4,919,341 | A | | 4/1990 | Lohnherr | |
| 5,137,218 | A | | 8/1992 | Sutherland et al. | |
| 5,230,474 | A | | 7/1993 | Yamaguchi et al. | |
| 5,386,619 | A | * | 2/1995 | Wark | B02C 15/007 241/109 |
| 5,839,673 | A | | 11/1998 | Williams | |
| 5,887,806 | A | | 3/1999 | Onken | |
| 6,390,396 | B1 | | 5/2002 | Takano et al. | |
| 6,537,596 | B1 | | 3/2003 | Junior et al. | |
| 6,766,864 | B2 | | 7/2004 | Clauss et al. | |
| 7,261,046 | B1 | | 8/2007 | Rettig et al. | |
| 7,909,273 | B2 | | 3/2011 | Andrews et al. | |
| 7,926,751 | B2 | | 4/2011 | Musch et al. | |
| 8,528,844 | B2 | * | 9/2013 | Horning | B02C 15/001 241/119 |
| 8,727,249 | B2 | * | 5/2014 | Horning | B02C 15/001 241/119 |
| 2010/0218591 | A1 | | 9/2010 | Rhodes et al. | |
| 2012/0111978 | A1 | | 5/2012 | Murphy et al. | |

FOREIGN PATENT DOCUMENTS

| | | | |
|---|---|---|---|
| EP | 1718413 | B1 | 10/2009 |
| RU | 2109569 | C1 | 4/1998 |
| RU | 2265644 | C2 | 12/2005 |
| SU | 1415410 | A1 | 8/1988 |
| SU | 1715410 | A1 | 2/1992 |
| WO | WO8806920 | | 9/1988 |
| WO | WO2011142368 | A1 | 11/2011 |

OTHER PUBLICATIONS

International Preliminary Report on Patentability for International Application No. PCT/US2013/039107, Jul. 31, 2013.

European Patent Office, English translation of abstract of foreign patent document CN101716540A, Jun. 2, 2010.

European Patent Office, English translation of abstract of foreign patent document RU2265644C2, Dec. 10, 2005.

European Patent Office, English translation of abstract of foreign patent document WO2011142368A1, Nov. 17, 2011.

* cited by examiner

PULVERIZER MILL PROTECTION SYSTEM

CROSS-REFERENCE TO RELATED APPLICATIONS

This application is a continuation in part of U.S. patent application Ser. No. 14/529,769, filed Oct. 31, 2014, which is a continuation in part of International Application No. PCT/US2013/039107, filed May 1, 2013, which claims priority to U.S. Provisional Patent Application No. 61/640,853, filed May 1, 2012. All of said applications are incorporated herein by reference.

TECHNICAL FIELD AND BACKGROUND OF THE INVENTION

The present invention relates to a protection system for pulverizer mills typically used in coal burning power plants, and other industrial coal burning facilities that may incorporate boilers, kilns or process heaters. An embodiment of the invention inhibits and suppresses fires, explosions and/or puffs in pulverizer mills, and provides control over high mill outlet temperature excursions. An embodiment of the invention can also be utilized on other solid fuel systems that incorporate pulverizer mills and/or pneumatic conveying systems for pulverized or granulated solid fuels. Various embodiments of the invention can include many advanced features and performance parameters providing benefits over existing steam, water, water fog or carbon dioxide inerting systems.

Fires and explosions in coal pulverizer mills can cause tremendous financial and operational burdens on coal fired power plants, as well as other coal fired boilers and industrial processes, especially those burning highly volatile coals such as Powder River Basin (PRB) coal. Along with posing a risk to worker safety, these events lead to financial losses incurred in repairs, lost power generation and litigation. Apart from regular mill maintenance, current techniques in dealing with fires and explosions rely on reaction to an event rather than prevention. Mill inerting, fire suppression, explosion venting and explosion suppression are all offline techniques, in that the mill must either be taken out of service for these techniques to be effective or the mill must be taken out of service following an explosion. Mill fires and explosions have many possible causes ranging from operator error to coal feed interruptions.

There are a variety of issues that can lead to mill fires or explosions. These may be maintenance related, caused by equipment failure or improperly following operational guidelines. However, many mill fires and explosions are caused by "hot restarts," a standard operating procedure which is generally accepted in the industry. A hot restart refers to starting a mill immediately after a trip. Trips often occur while the pulverizer is loaded with coal. With vertical spindle style mills, a loss of airflow during such a trip means that coal that previously was suspended above the grinding bowl or table falls down to the hot underbowl area where temperatures often exceed 650° F. In this high temperature region of the mill, coal quickly dries and, especially in the case of PRB coal and similar highly volatile coals, spontaneously ignites and begins to smolder. When airflow is reintroduced, coal that was previously in mounds with little access to oxygen become suddenly suspended. Often these accumulations or mounds of coal are smoldering or burning because they have settled into a high temperature area of the coal mill, and are agitated and suspended in air. Once suspended, more surface area is exposed to oxygen, resulting in the often catastrophic combination of high air-to-fuel ratio, high temperatures and an ignition source that could result in an explosion.

Often mill fires start after a mill has stopped either due to a trip or as part of a controlled shutdown. Temperatures in the mill rise for a period after the mill is taken off when the heat stored in the thick metal mill housing migrates into the vessel. The resulting rise in temperature causes any coal remaining in the mill to dry and ignite. Left undetected, such fires can grow into major issues when primary airflow is reintroduced. Due to this threat, control room operators are prone to error. Operators are often tasked with watching indicated mill outlet temperature for hours after a mill is taken offline and introducing cold airflow if temperatures rise above normal operating levels.

While manual startup and shutdown is often preferred over automatic routines for a variety of reasons, a small oversight on the part of the operator may lead to catastrophic events. For instance, if a feeder is started late during the startup process, temperatures may spike because an absence of coal flow means an absence of the moisture content of the coal. If coal is introduced too late into the startup procedure for temperatures to be kept below blast gate trip temperatures, again the hazardous combination of high temperatures and dry coal is likely. During shutdown, if an operator fails to stop hot airflow when fuel feed is stopped, air-to-fuel ratio and temperature will go high, increasing the potential of an explosion or fire.

Mill fires have been known to erupt because a mill, still loaded with coal, which has been isolated from air supply, is opened for inspection. These fires most often occur when a mill has not fully cooled to ambient temperatures. Opening the mill stirs up previously settled coal dust and introduces $O_2$ into a mill that may or may not have previously contained an inert atmosphere. This scenario may lead to injury or death.

Improperly maintained or otherwise malfunctioning equipment or measurement instrumentation is another major cause of mill fires. Coal feed interruptions, resulting from mechanical issues or plugged coal feed pipes, often result in high temperatures and air-to-fuel ratios. Improper airflow or temperature indications also have the potential of causing issues. For instance, an indicated temperature that is much lower than actual mill outlet temperature can lead to driving the mill temperature dangerously high. Improper airflow indication has the potential to lead to coal spillage into the underbowl because of insufficient airflow. Stuck or otherwise compromised hot or cold air dampers also have the potential of causing high temperatures, insufficient velocities or high air-to-fuel ratios, while worn or eroded pulverizer components may allow for coal to settle or spill over into the underbowl.

There are inerting systems and explosion suppression or venting systems known in the art. Inerting systems are designed to limit the amount of oxygen in the mill by injecting a noncombustible, nonreactive gas into the vessel. Gases used for this purpose are typically steam, nitrogen, carbon dioxide or flue gases. While inerting is effective at extinguishing smoldering or burning materials inside the mill, this method only works when a mill is isolated. This means that the mill operations, coal and airflow must cease and that all inlet and outlet gates are closed. Under these mandatory conditions the pulverizer is inerted and a based characterization test performed during commissioning. It is perceived that all other parameters that affected this characterization test remain constant after commissioning. However, if a damper leak is detected or an improper measurement of media flow rate, this may lead to oxygen levels that exceed the intended ten to fourteen percent oxygen by volume. Without reliable and continuous $O_2$ measurement, such issues may go undetected. Steam inerting can be effective in displacing oxygen in the pulverizer, but it must be insured that the steam does not condense due to falling below saturation temperature and pressure. Generally, steam cannot be relied upon to extinguish a fire.

Explosion suppression and venting solutions react to dust explosions by either rapidly combining the combustible coal dust with a noncombustible dust (phlegmatization) and by venting the explosion pressure with explosion doors, respectively. These methods are purely reactive and result in pulverizer downtime and unit derates. In the case of explosion suppression systems, the mill must be isolated and cleaned out and the suppressant canisters reloaded. In the case of explosion venting, explosion doors or rupture disks or panels must be replaced. In either case, further downtime is incurred since the mill must be thoroughly inspected after an explosion.

Existing inerting systems concentrate on inhibiting mill fires during start up and shut down. Existing steam, water and carbon dioxide systems typically provide minimal or no fire suppression capability inside the pulverizer, while the mill is in service.

The objective of more rapid cooling of pulverizers is to shorten the time required for maintenance outages and inspections by permitting quicker entry into the pulverizer internals after it has been removed from service. If a fire occurs, the fire can be extinguished quickly preventing damage, costly repairs and extended downtime that is typical following a mill fire incident.

Temperatures within coal pulverizer mill internals vary greatly and can reach 700 degrees Fahrenheit during normal operation, especially while firing high moisture sub-bituminous coals. During normal and continuous operation, the highest temperatures are constrained or isolated to areas of the mills where there is usually no coal, dust or combustible material. Certain conditions such as interruptions in raw coal feed or other mechanical and operational anomalies can allow the high temperatures inside the mill to migrate to other areas of the pulverizer mill where pulverized and granulated combustion material (coal or other solid fuel) exist. This usually manifests itself as a temperature excursion where mill outlet or discharge temperature is abnormally high. There is a high risk of fires or puff evolving while mill outlet temperature is abnormally high.

Coal pulverizer mill fires and explosions present a major safety and financial concern for owners and operators of coal fired boilers and utilities. Such incidents can damage or completely destroy the mill and ancillary equipment. Workers in the vicinity of the mill may be injured or killed by thermal injury, hot gases and/or flying debris. Another concern is combustible dusts on and around ancillary equipment in the area that can result in secondary explosions or fires.

A commonly relied upon method of suppressing a fire inside a coal pulverizer/mill is increasing coal feed to flood the mill with fuel to decrease temperatures in the mill and smother the fire by inducing a fuel rich environment. Flooding the mill that is a closed system can reduce the air/oxygen available to support combustion inside the mill as well as maintain air to fuel ratios below the level necessary to support a pulverizer puff or explosion. Coal also contains moistures. Some coals are greater than twenty-five percent moisture by weight, and flooding the mill with moist fuel reduces temperature. To address internal mill fires, most fire suppression systems known in the art douse the mill externally with water, and are ineffective at suppressing fires inside the classifier and grinding/pulverization zones of coal mill/pulverizers. Other strategies to control, suppress or mitigate damage caused by a mill fire can include closing air inlet dampers (primary air dampers, hot air blast gates or other guillotine type isolation dampers) and fuel or burner lines or conduits using burner shut-off valves or isolation gates, in order to remove sources of oxygen (bottling), and filling the mill with steam or water fog (inerting). These methods typically require several hours to completely suppress a fire and most often do not suppress the fire quickly enough to prevent substantial damage to the mill or pulverizer system. Heat and combustibles, such as gases and coal dust remaining in the mill after suppression, present the risk of re-ignition. This system will address neutralizing the combustible material inside a mill while it is out of service as well as enhancing cooling limiting risk associated with re-ignition. The high temperatures inside the mill after suppression mean that a long cooling period is required before maintenance crews may enter the mill to assess and repair damage. Similarly, in non-emergency maintenance and inspection situations, the mill must be cooled from operating temperatures (it is also typical that the process of removing a pulverizer from service sometimes allow the mill to get heated above normal operating temperatures), adding several hours to the process of maintaining and inspecting the mill.

In addition, the numerous components typically contained in a coal pulverizer mill create a number of enclosed and isolated spaces within the coal pulverizer mill, in which fires can ignite. Accumulations and settling of fine coal particles inside the mill/pulverizer components can spontaneously ignite, particularly in mills with highly reactive sub-bituminous coals. In addition to spontaneously igniting, accumulations of coal pulverized to small particles can be easily ignited during the start-up process where these particles are agitated and exposed to a high air to fuel ratio environment as well as the possibility of high temperature excursions. Raw coal supply interruptions due to imprecise feeder control and stoppages above and below the feeder are another common source of fires and puffs. Interruptions in raw coal feed can be caused by environmental conditions such as frozen coal, wet coal from precipitation and mechanical anomalies such as broken feeder belts, seized bearings and other causes. Also, accumulations of raw coal that has spilled over into the under bowl section are exposed to temperatures of 500° F. to 750° F. while firing sub-bituminous coal, and are another common cause of mill fires. As such, there is a need for a fire suppression system that can effectively suppress and extinguish fires and explosions in all internal areas of the pulverizer mill.

SUMMARY OF EMBODIMENTS OF THE INVENTION

One object of the present invention is to provide a system that prevents or inhibits pulverizer mill explosions, fires and/or puffs during mill start-up and shut down. Another object of the invention is to prevent or inhibit pulverizer mill fires by controlling high mill outlet temperature excursions. Another object of the present invention is to provide a capable and effective fire suppression system to address fires in all areas of the mill internals.

Yet another object of the invention is to provide a system that aids in controlling combustible dusts, vaporous gases, and accumulations of smoldering coal that are sometime common with highly reactive coals such as Powder River Basin coal and other sub-bituminous coals. Another object of the invention is to control combustible dusts and gases utilizing a solution with micelle encapsulation properties. Yet another object of the present invention is to provide for rapid and more uniform cooling of coal pulverizing mills for inspection and maintenance purposes.

Yet another object of the invention is to prevent or inhibit mill fires, explosions and/or puffs due to coal feed interruptions, such as wet coal and feeder problems.

Yet another object of the invention is to neutralize the hazards associated with residual coal dusts inside the mill/pulverizer after a pulverizer is taken out of service that can reignite either during the mill start-up process.

Yet another object of the invention is to provide an internal fire suppression extinguishing system capable of extinguishing fires in seconds, preventing damage to the mill, piping, external wiring, instrumentation and other ancillary equipment. This system is intended for internal fire suppression, but can incorporate an external fire suppression using shared components.

Yet another object of the present invention is to provide external fire suppression that helps control and manage combustible dust on the mill exterior and improves housekeeping in the mill bay areas.

Yet another object of the present invention is to provides an effective tool to manage mill outlet temperature excursions before they evolve into fires, and avert derates from tripped mills, forced outages and mill damage.

Yet another object of the present invention is to provide rapid cooling of the mill internals to reduce mill downtime for emergency repairs, preventive maintenance, inspections or mechanical adjustments.

Yet another object of the present invention is to provide vapor encapsulation to eradicate combustible gases such as methane that can cause coal dust to ignite more easily and increase explosion force.

Yet another object of the present invention is to provide a fire suppression system that can be operated while the mill is in service to prevent mill fires (due to high mill outlet temperature excursions) from spreading to the burner lines.

Yet another object of the present invention is to provide a fire suppression system requiring less water than prior suppression systems, reducing thermal stresses and cracking of grinding elements, grinding and bull rings, rotating throats, mill side liners, and other internal components.

Yet another object of the present invention is to provide a suppression system that can function as mill internal wash down, reducing the chance of residual coal dust in the mill interior when removed from service.

Yet another object of the present invention is to provide a suppression system that can be integrated into a total fuel burning system protection system that incorporates the bunker/silos, trippers, feeders, mills and burner lines.

These and other objects of the invention may be achieved in various embodiments of the invention described below. One embodiment of the invention comprises a fire suppression, cooling and mill inerting system that inhibits coal pulverizer mill fires, explosions and/or puffs, as well as control vaporous combustible gases emitted from the coal inside an idle mill. The system injects a fire suppression solution as a mist through multiple nozzles located at various points in the coal mill/pulverizer. The fire suppression solution can be comprised of water and a fire suppression agent. Preferably, the fire suppression agent is a chemical agent that provides for micelle encapsulation such as the water additive suppression agent currently sold by Hazard Control Technologies, Inc. under the name F-500 MULTI-PURPOSE ENCAPSULATOR AGENT (hereinafter "F-500"). Another preferred fire suppression agent is the water additive suppression agent currently sold by Hazard Control Technologies, Inc. under the name TSEA (Temperature Suppression Encapsulation Agent). Injection points are located at the primary air duct, classifier, under bowl or under table zone and grinding zone of the mill. Additional nozzles may be placed around the exterior of the mill for the purpose of extinguishing external fires and managing combustible dust on the mill exterior. The system can be operated in a stand-alone configuration or as part of a total fuel burning system protection scheme that incorporates the bunker/silos, trippers, feeders, mills and burner lines. The system can be used while the mill is in service to prevent mill fires from spreading to the burner lines and may be utilized during start-up/shut-down when the risk of mill explosion and puff are particularly high. The system can provide protection while the mill is in service in addition to during start-up and shut down (i.e. starting and stopping the pulverizer).

It is believed that fires can be suppressed in a fraction of the time when compared to traditional methods utilizing steam or water fog. This quick action reduces the chance of damage to the mill, piping, external wiring, instrumentation and other ancillary equipment. Less water is required compared to traditional methods, reducing thermal stresses and cracking of grinding elements, grinding/bull rings, rotating throats, mill side liners and other internal components. The system can provide vapor encapsulation to eradicate combustible gases, such as methane, that can cause coal dust to ignite more easily and increase explosion force. This, along with the speed at which the solution cools mill internals, reduces the risk of reignition.

An embodiment of the invention comprises a system utilizing the F-500 suppression solution or similar agent that provides for micelle encapsulation or greater thermal capacity for cooling. The system can benefit routine maintenance operations. The rapid cooling provided by the system shortens downtime required for emergency repairs, preventive maintenance, inspections or mechanical adjustments. Since the F-500 suppression solution is a non-corrosive, biodegradable and non-toxic agent, the system is viable for use in non-emergency, routine maintenance situations as no special cleaning equipment is required after its use. Maintenance crews can enter the confined space without risk of injury due to trapped steam, heat or hazardous fumes. In instances where a mill is to be removed from service, the system can be used for a mill internal wash down to reduce residual coal dust in the mill interior. External fire suppression nozzles may also be used to help control combustible dust on the mill exterior and improve housekeeping in the mill bay areas.

According to another embodiment of the invention, a plurality of nozzle assemblies are strategically located in four or five different zones of the coal pulverizer that are known to be problematic areas and typically inaccessible by existing systems. A control algorithm can selectively control spraying of the nozzle assemblies in a specific sequence or specific nozzle assemblies depending on the operating mode or operating parameters of the coal pulverizer. As such, the system has the ability to trigger nozzle assemblies in specific zones and introduce inerting media into targeted areas independently.

An embodiment of the invention comprises a system having a first set of injection points for introducing a fire suppression solution located in a circular array around the raw coal feed inlet on the upper housing of the mill above the classifier cone, and a second set of injection points located in a circular array on the outer edge of the upper housing outside the classifier region. The system uses the injection arrays and the properties of the fire suppression solution injected through the arrays to manage temperature excursions and reduce peak temperatures during operational and mechanical anomalies that cause high pulverizer mill discharge temperature excursions. The system provides effective fire suppression as well as aids in controlling the environment inside the mill to prevent fires from occurring in the first place.

According to another embodiment of the invention, the system can also include a third set of injection points located at the pulverizer primary air inlet where hot air for drying and transporting the coal first enters the mill.

According to another embodiment of the invention a fourth set of injection points can be located in the under bowl, also known as the under table, primary air windbox, wind belt, as well as other terms referring to the area under the grinding table.

According to another embodiment of the invention, a fifth set of injection points can be in the grinding zone above the grinding table where the grinding elements are located.

DETAILED DESCRIPTION OF PREFERRED EMBODIMENTS OF THE INVENTION AND BEST MODE

Figure 20:
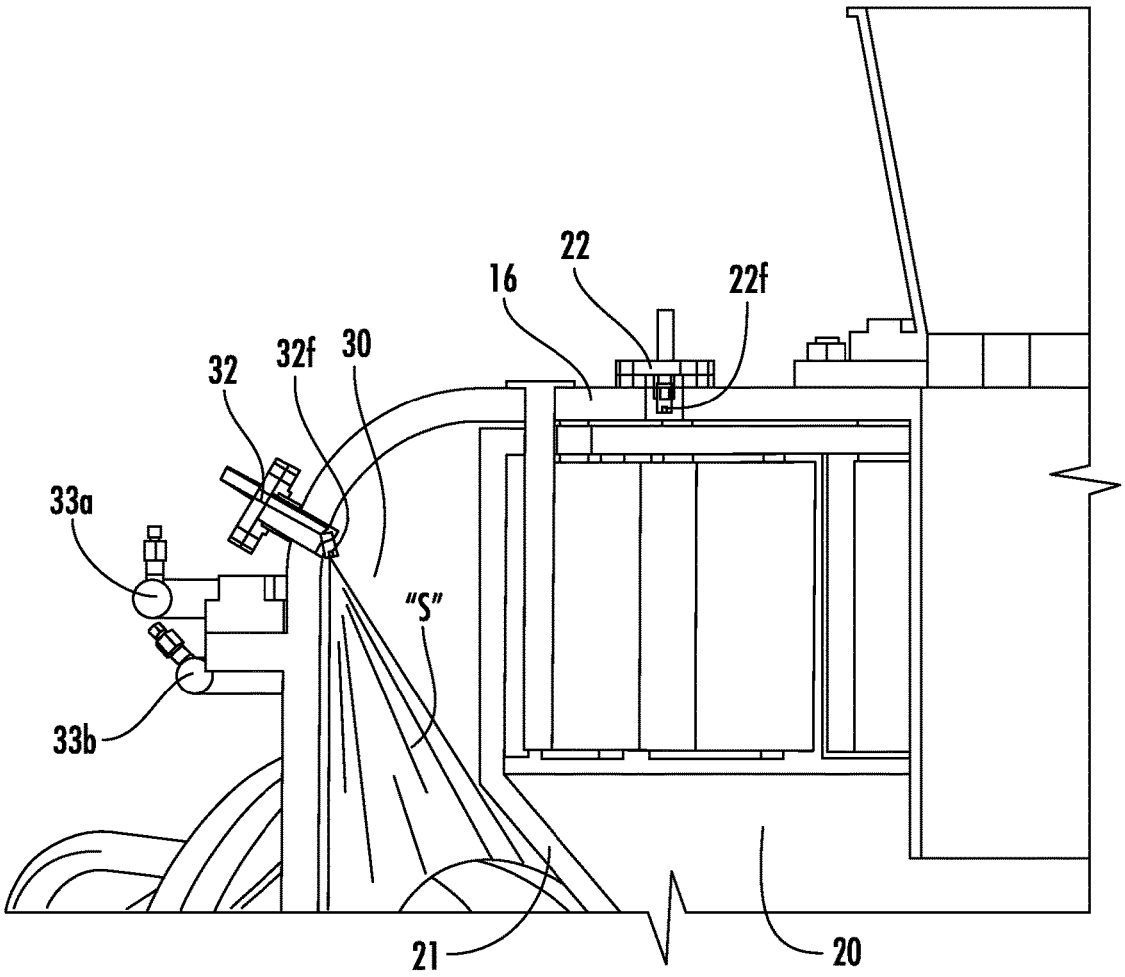
FIG. 20 is another partial cross sectional view of the system of FIG. 1.
Figure 21:
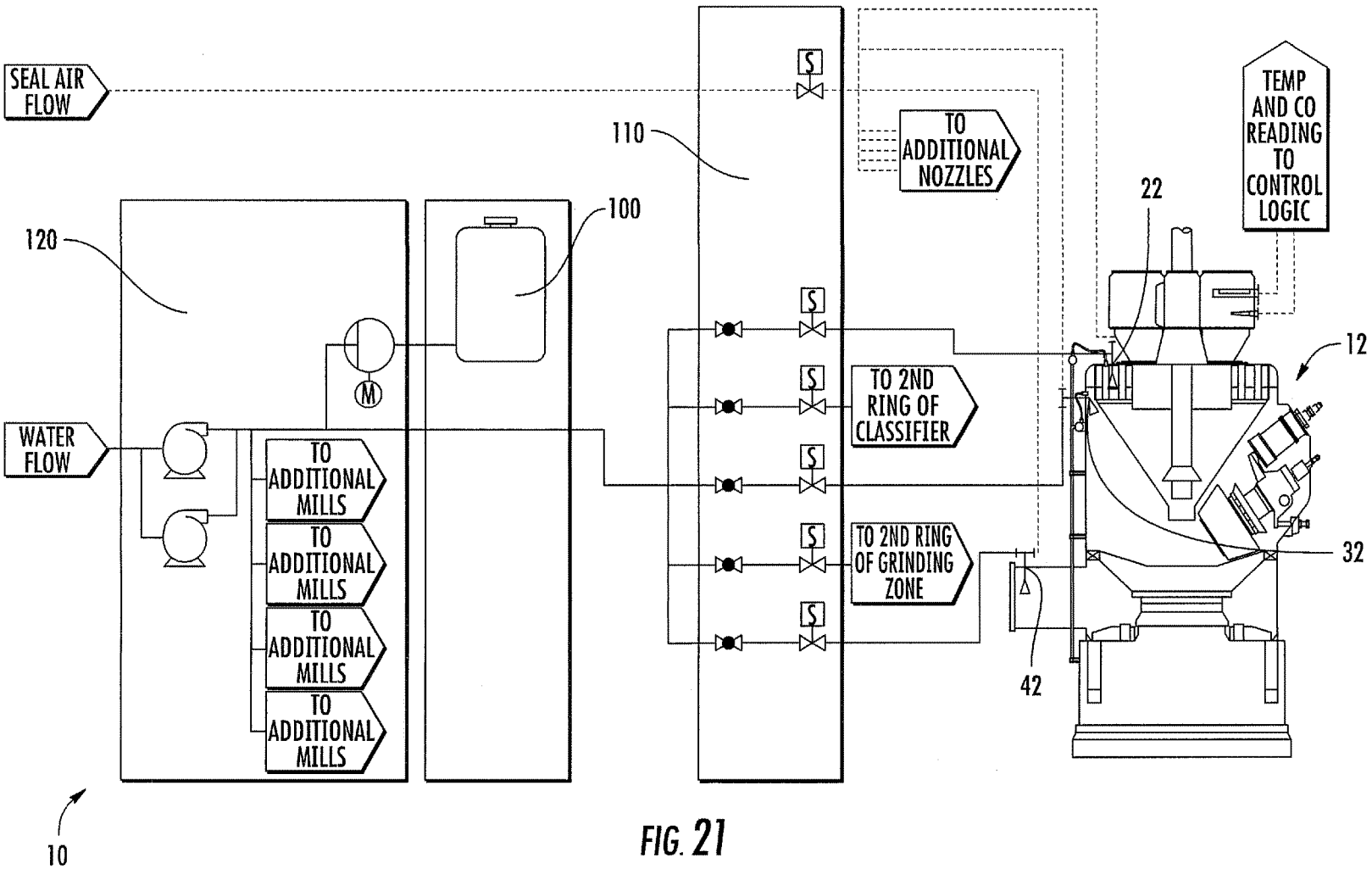
FIG. 21 is a schematic view of a pulverizer mill protection system according to a preferred embodiment of the invention.

A pulverizer mill protection system according to a preferred embodiment of the invention is illustrated in FIGS. 1-21, and shown generally at reference numeral 10 in FIG. 21. The system 10 generally comprises five subsystems: concentrate and/or solution storage tank(s) 100, a flow control cabinet 110, an equipment control/pumping enclosure 120, an air distribution system, and injection piping and nozzles installed in a pulverizer mill 12, described in detail below.

The equipment control/pumping enclosure 120 can accommodate all mill types/models, and houses multiple water pumps and multiple chemical pumps. The enclosure 120 includes isolation and/or bypass valves for water pump isolation/bypass, and chemical metering pump bypass (to allow clean water to be used for housekeeping). The equipment control/pumping enclosure 120 houses a programmable logic controller, and control equipment. The enclosure can be heated and ventilated, and can accommodate any voltage configuration.

The chemical storage tank(s) 100 can be standard 330 gallon size. The storage tank(s) 100 can be connected via a common header to one or more control/pumping skids 110. The number of tanks 100 and skids 110 can vary depending on the size and number of coal pulverizer mills 12 on site and the need for optional external fire suppression.

A flow control cabinet 110 is assigned to each mill 12. The cabinet includes electronically actuated solenoid valves, and individually controlled, multi point outlet zones within each cabinet 110. Preferably, the cabinet 110 includes two outlets for two sets of classifier zone nozzles 22, two zones for two sets of grinding zone nozzles 32, and one zone for the primary air inlet zone nozzles 42.

The system 10 includes a fire suppression solution. Preferably, the fire suppression solution is formed by mixing a chemical fire suppression agent such as F-500 directly into a flowing water stream at a concentration of about one percent. The F-500 concentrate can be held in an IBC chemical storage tote and fed into the plant service water stream by way of a rotary water dosimeter or chemical feed pump. The chemical fire suppression agent can suppress temperature more quickly with less water. The agent can also function as a surfactant reducing the surface tension of water. It is believed that smaller water droplet size allows for quicker cooling. Use of this chemical agent also suppresses fires more quickly with little to no secondary combustion of coal dust particles that are agitated and suspended with spray with the solution.

The suppression solution can be delivered to the mill 12 by opening an electronically or pneumatically actuated valve located at the header outlet. The valve may be opened either by pushbutton at the control/pumping skid when in "Hand" mode or remotely by way of remote I/O switching from the control room when set to "Auto" mode. A VFD controlled booster pump ensures proper pressures required for delivery of the solution to injection nozzles in the pulverizer mill 12. The remote I/O provides the possibility of manually triggering the system from the control room or being part of an automated system triggered either by high temperature measures at the mill exit or a number of currently available methods of detecting mill fires.

Figure 1:
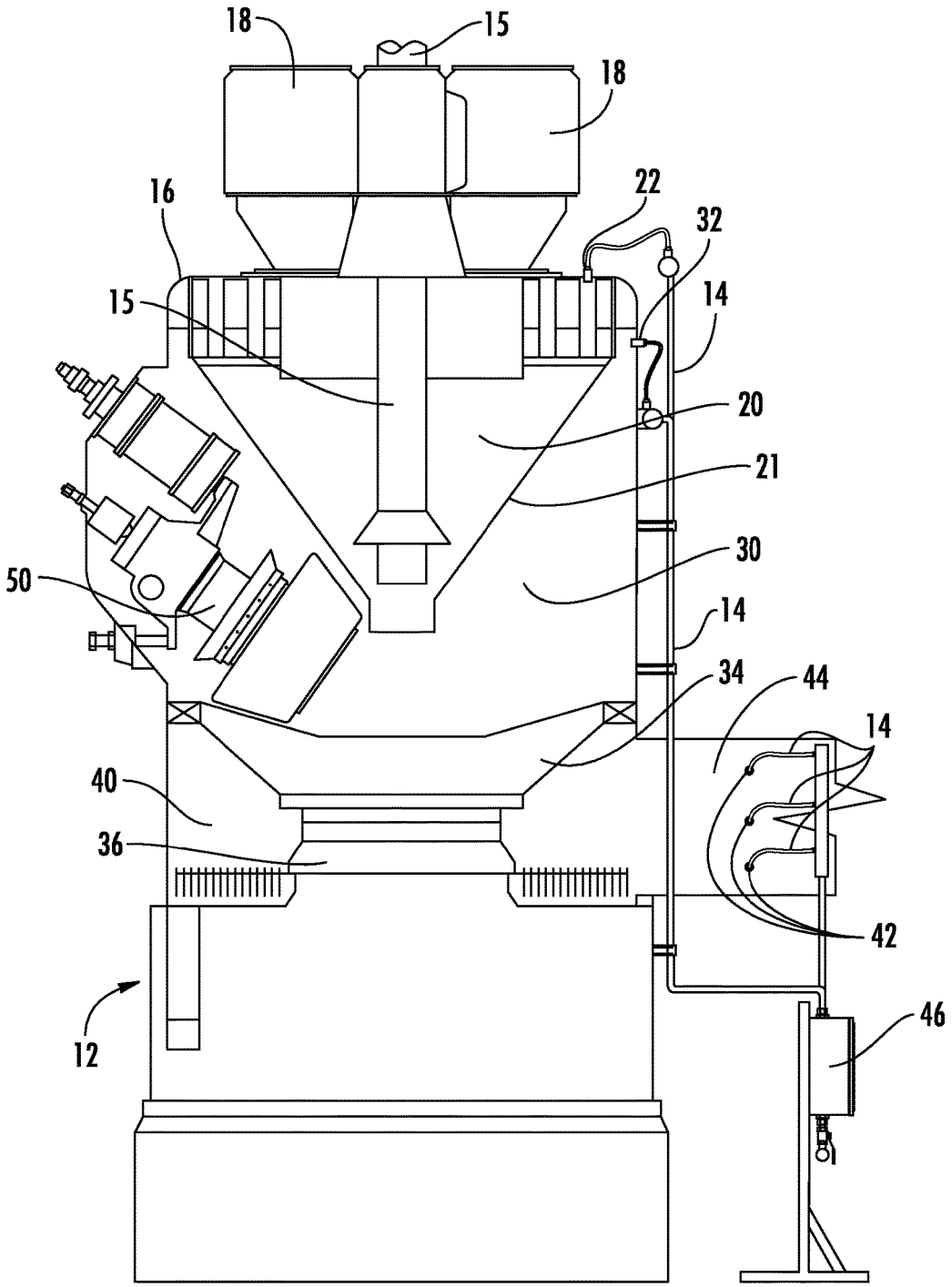
FIG. 1 is a cross sectional schematic view showing a pulverizer mill protection system according to a preferred embodiment of the invention.
Figure 4:
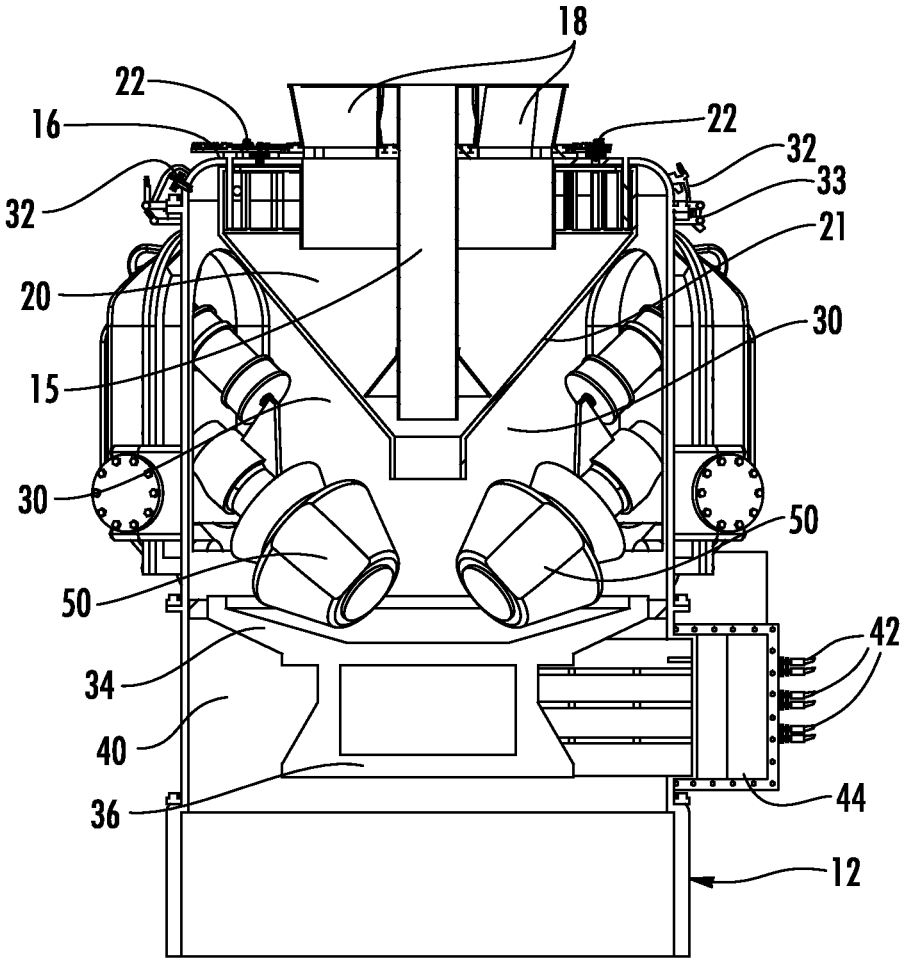
FIG. 4 is a cross sectional view of the system of FIG. 1 taken along lines 4-4 of FIG. 3.
Figure 5:
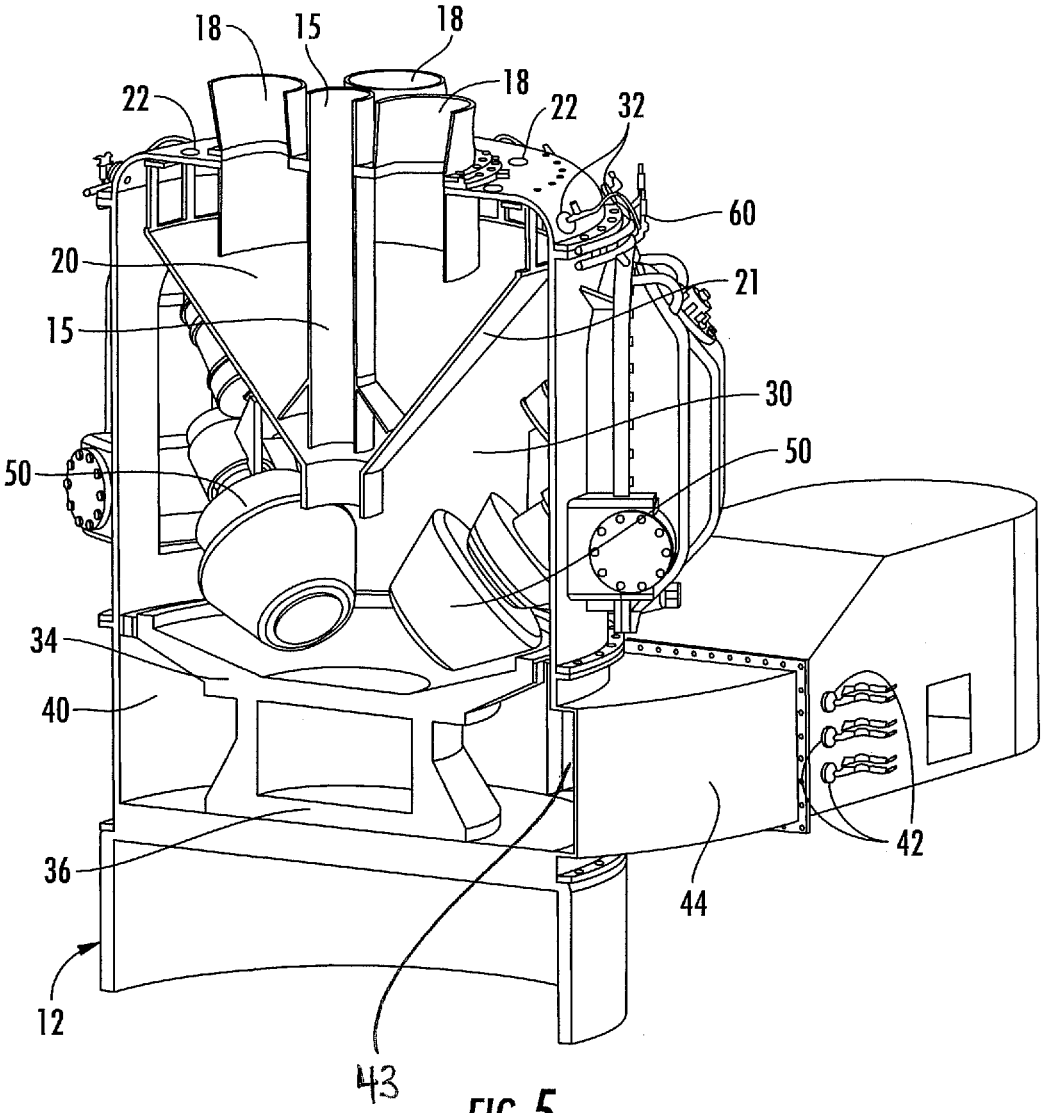
FIG. 5 is a cross sectional perspective view of the system of FIG. 1.

The solution is delivered to the mill 12 in steel piping and flexible stainless steel hose 14 to one of a plurality of injection nozzles positioned on the pulverizer mill 12 and jettisoned into one of three regions of the mill 12: the classifier zone 20, grinding zone 30 and primary air inlet zone 43. As shown in FIGS. 1 and 4, the classifier zone 20 refers to the area within the classifier cone 21, also known as an oversize return or tailing discharge. The grinding zone 30 refers to the area within the mill 12 outside of the classifier cone 21 and above the bull ring 34, as shown in FIGS. 1 and 4. The grinding zone 30 includes the area in which the grinding elements 50 are positioned. The grinding elements 50 can be comprised of a plurality of journal grinder and spring pressure assemblies 50, as shown in FIGS. 4 and 5. The system 10 can be utilized with mills having alternative grinding elements, such as ball and race or roll and race grinding assemblies. The primary air inlet zone 43, shown in FIG. 5, refers to the interior area of the primary air duct 44 proximate the inlet to the under bowl zone 40 of the pulverizer 12. The under bowl zone 40, refers to the area below the bull ring 34 and above the bull gear 36, as shown in FIGS. 1 and 4.

Figure 2:
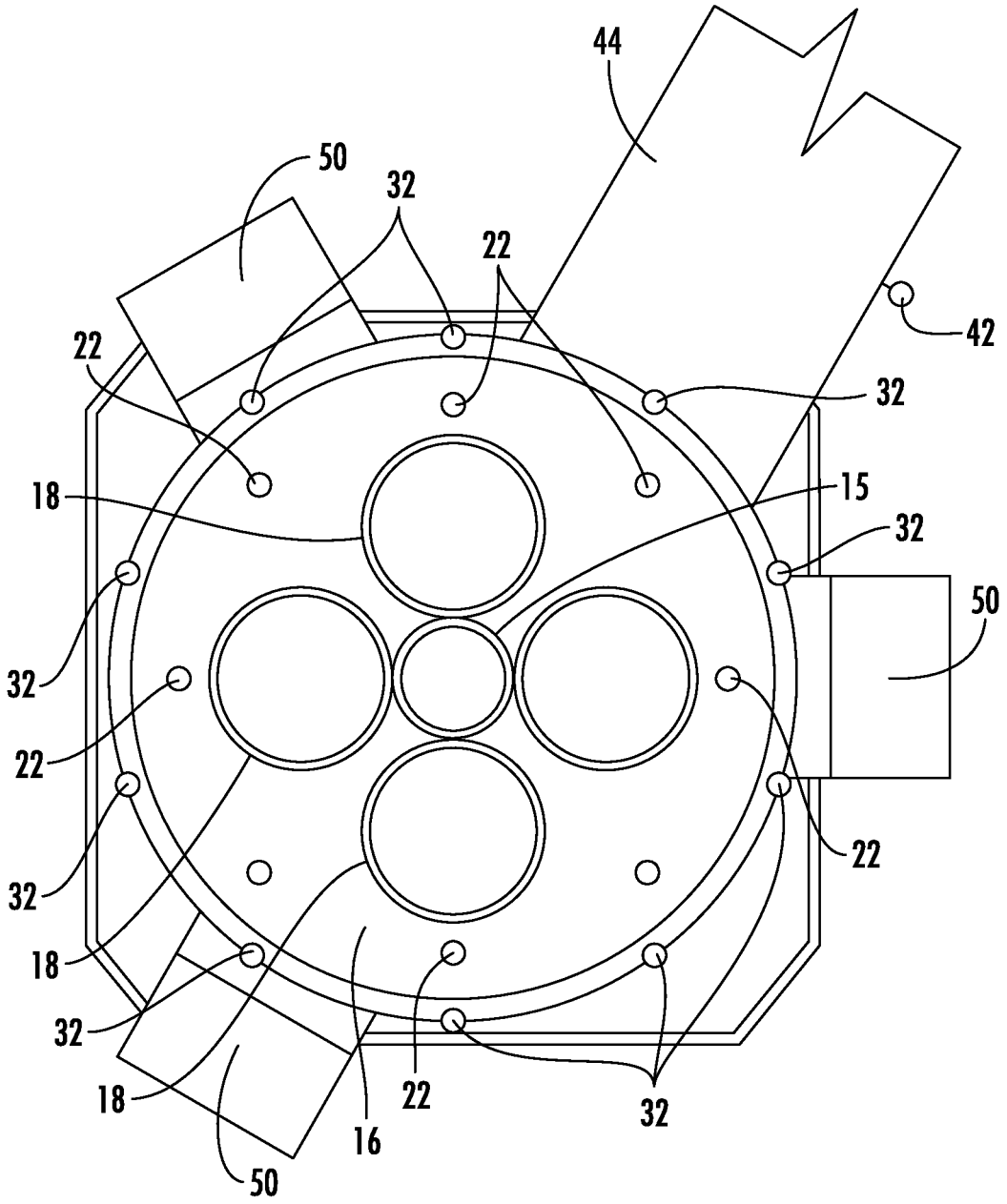
FIG. 2 is a top schematic view showing the classifier and grinding zone injection locations on the upper housing of the system of FIG. 1.
Figure 3:
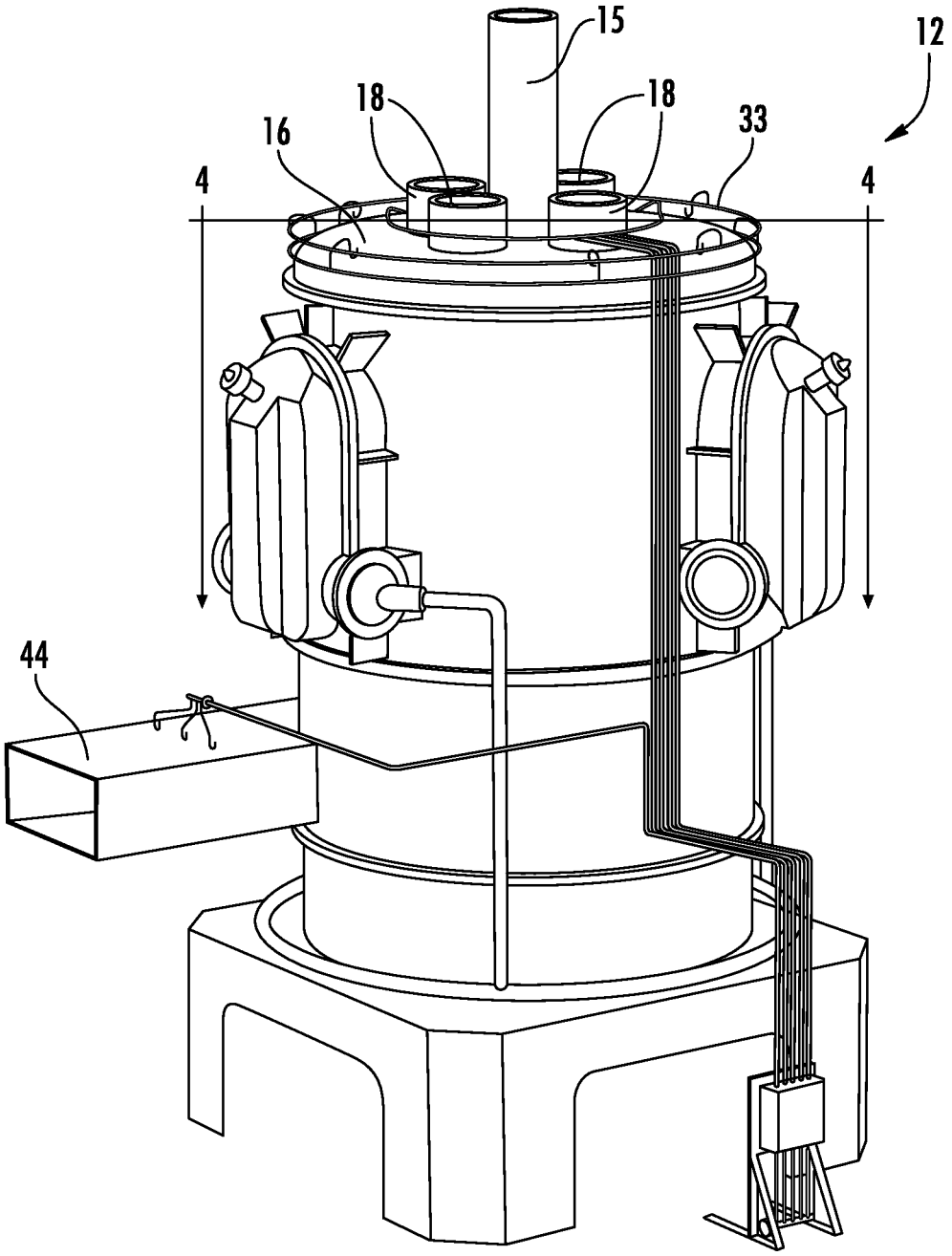
FIG. 3 is a perspective view of the pulverizer of the system of FIG. 1.
Figure 6:
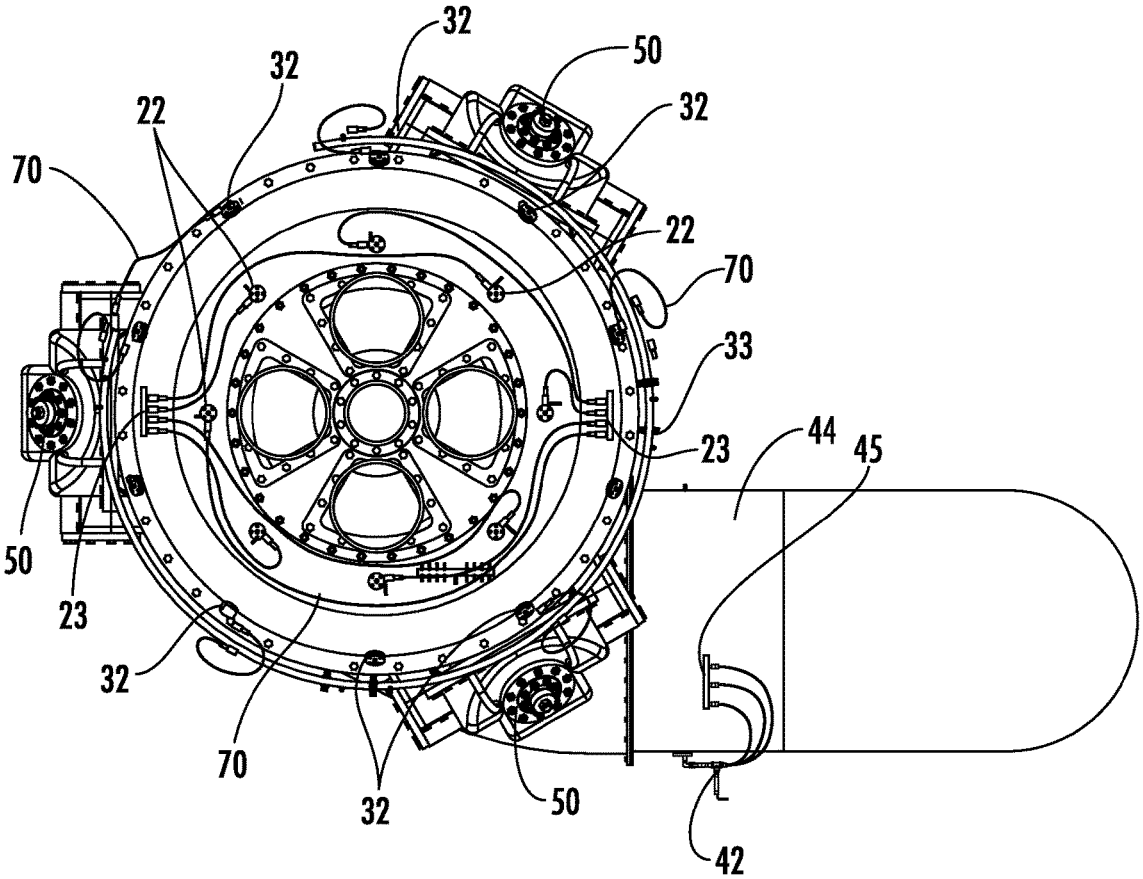
FIG. 6 is a top plan view of the system of FIG. 1.
Figure 7:
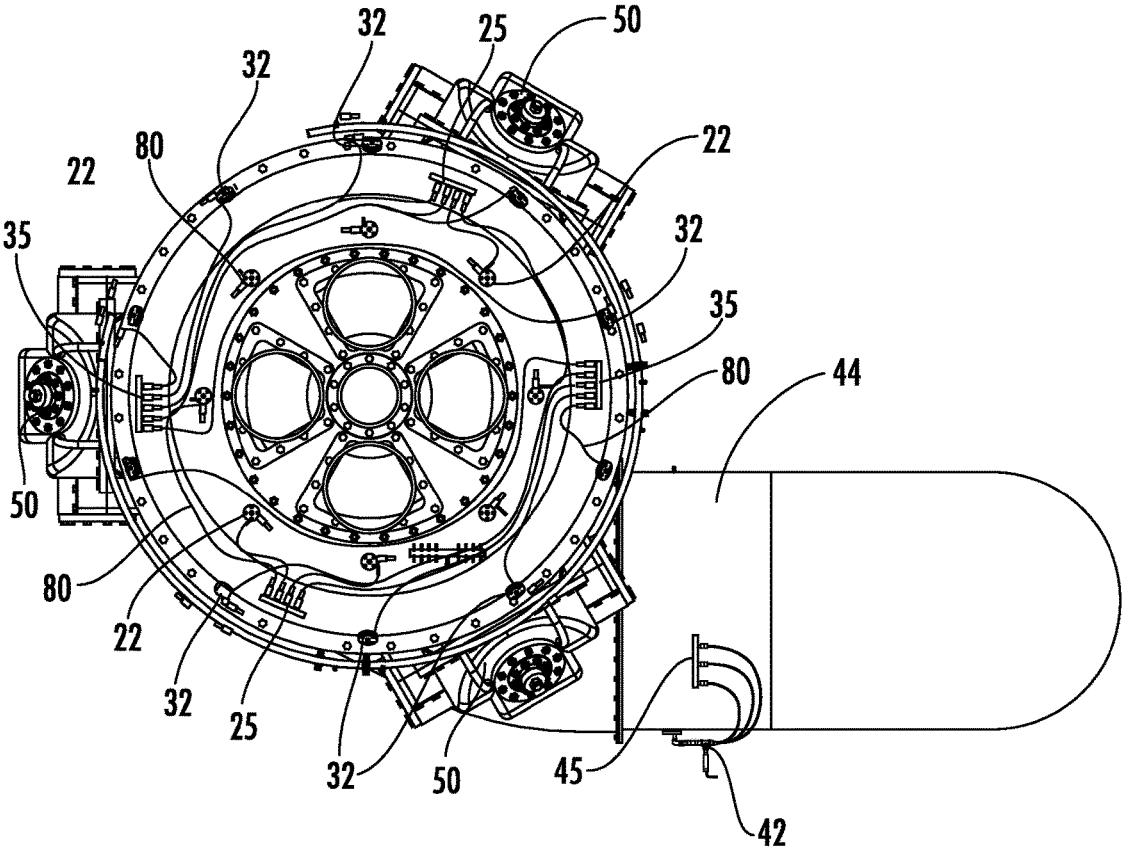
FIG. 7 is another top plan view of the system of FIG. 1.

The system 10 includes three groups of injection nozzle assemblies 22, 32, 42 positioned to introduce the fire suppression solution into the three regions 20, 30, 40 of the mill 12. The first group is comprised of classifier injection nozzle assemblies 22 positioned in a first circular array around the raw coal feed inlet 15 and outlets 18 through the upper housing 16 of the mill 12 above the classifier cone 20, as shown in FIGS. 2, 6 and 7. A first plurality of classifier injection nozzle assemblies 22 can be located inside the outlet skirt/deflector, and a second plurality of nozzle assemblies can be located outside the outlet skirt/deflector. The second group of nozzle assemblies is comprised of grinding zone injection nozzle assemblies 32 positioned in a second circular array proximate the outer edge of the upper housing 16, outside the classifier zone 20, as shown in FIG. 2. The third group of nozzles is comprised of pulverizer inlet nozzle assemblies 42 positioned in the primary air duct 44, a short distance upstream from the pulverizer 12, as shown in FIG. 4. A distribution valve enclosure 46 provides automated valves that control the flow of water and encapsulator agent flow to the various nozzles 22, 32, 42.

The stainless steel braided hoses 14 can be connected to the nozzles 22, 32, 42 by way of a quick release coupling. This allows the maintenance crews to move the hoses out of their way thus reducing tripping hazards when servicing the top of the mill.

Upon triggering by either manual activation or by automated detection system, the nozzle assemblies 22, 32, 42 disperse a fine mist of the fire suppression solution into the mill 12. The classifier injection nozzle assemblies 22 deliver fire suppression solution into the classifier zone 20. The grinding zone injection nozzles 32 deliver fire suppression solution "S" into the grinding zone 30, as shown in FIG. 20. The pulverizer inlet injection nozzle assemblies 42 deliver suppression solution into the pulverizer inlet zone 43.

The pulverizer mill protection system 10 provides an effective tool to manage mill outlet temperature excursions before they evolve into fires and averts de-rates due to tripped mills, forced outages and mill damage. Because the system 10 operates continuously while the mill 12 is in service, fires are suppressed in a fraction of the time when compared to traditional methods utilizing steam or water fog. The rapid fire suppression/extinguishing means fires are eliminated in seconds; preventing damage to the mill, piping, external wiring, instrumentation and other ancillary equipment. This is achieved by injecting a water and F-500 solution as a fine mist through numerous nozzles strategically placed in the pulverizer. The system also prevents or inhibits mill fires, explosions and puffs due to coal feed interruptions or during mill start-up and shutdown. In addition, the system prevents mill fires from spreading to the burner lines. Less water is required and cooling is more uniform compared to traditional steam and water fog systems, reducing thermal stresses/cracking of grinding elements, grinding and bull rings, rotating throats, mill side liners and other internal components. The same F-500 system can be used inside and outside the mill 12. The F-500 EA MPS can be integrated to protect the entire fuel burning system, including the bunker/silos, trippers, feeders, mills and burner lines.

The pulverizer mill protection system 10 can be useful for routine maintenance operations. The rapid cooling of mill internals reduces mill downtime for emergency repairs, preventive maintenance, inspections or mechanical adjustments—possibly shortening mill outages from twenty-four hours to a few hours or less. Since the F-500 is a non-corrosive, biodegradable and nontoxic agent, the system 10 is viable for use in non-emergency, routine maintenance situations as no special cleaning equipment is required after its use. Maintenance crews may enter the confined space without risk of injury due to trapped steam, heat or hazardous fumes. In instances where a mill is to be removed from service, the system may be used for a mill internal wash down to reduce residual coal dust in the mill interior. External fire suppression nozzles may also be used to help control combustible dust on the mill exterior and improve housekeeping in the mill bay areas.

Figure 22:
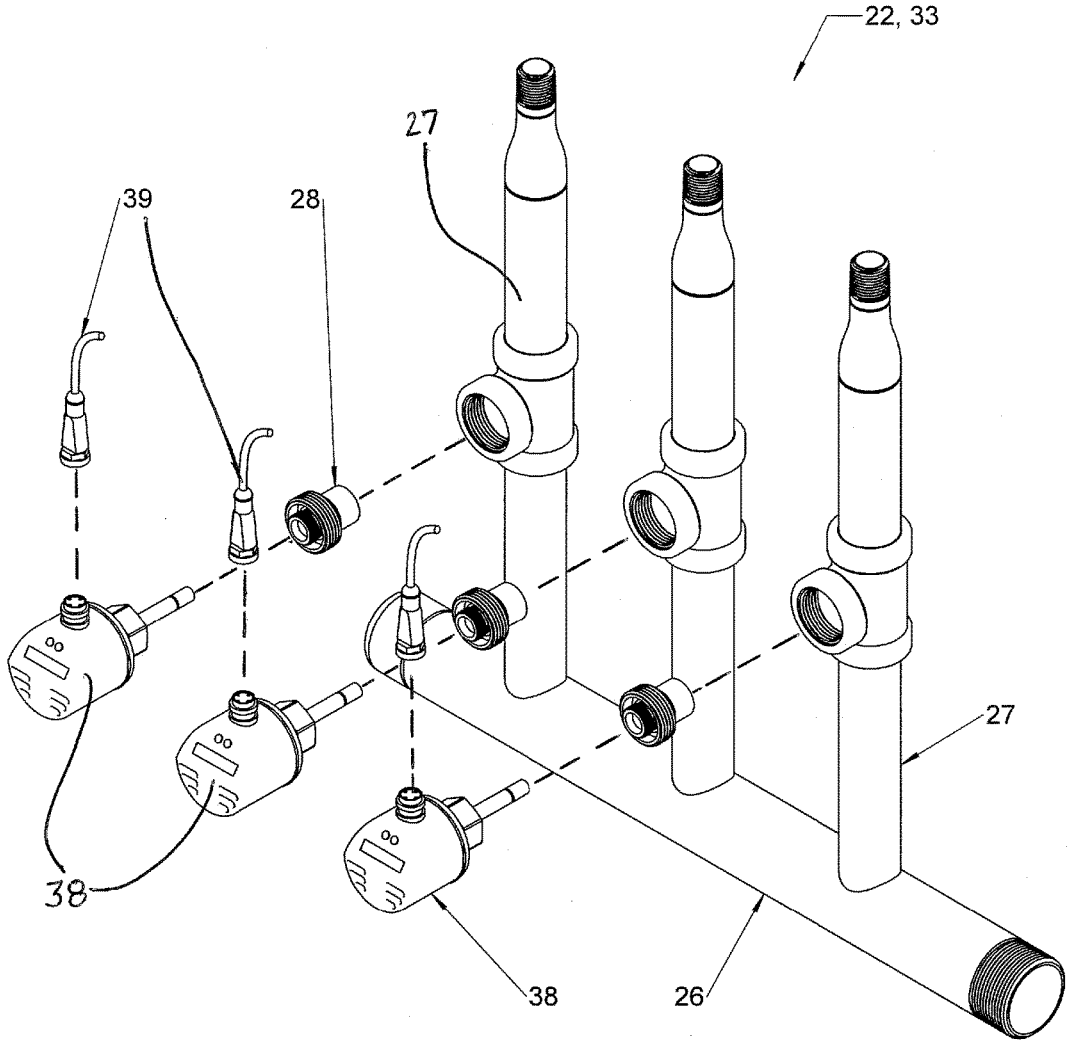
FIG. 22 is an enlarged exploded view of a nozzle assembly according to a preferred embodiment of the invention.

The system 10 includes a solution delivery system for delivering the fire suppression solution to the nozzles 22, 32, 42. As shown in FIG. 6, the solution delivery system can comprise manifold assemblies 23, 33. Classifier zone manifolds 23 are connected to the classifier zone nozzle assemblies 23 by solution delivery piping 70, shown in FIG. 6. Ring manifolds 33 are connected to the grinding zone nozzle assemblies 33 by piping 70, shown in FIG. 6. As shown in FIG. 22, each manifold assembly 23, 33 can be comprised of a solution manifold 26 connected to a plurality of solution manifold outlets 27. A flow meter adapter 28 is connected to each solution manifold outlet 27, and receives a flow meter 38. Each flow meter 38 can be connected to a flow meter cord 39. The flow meters provide feedback to the controls with alarms for high flow (indicative of a worn nozzle) or low flow (indicative of plugging or a flow obstruction).

Figure 19:
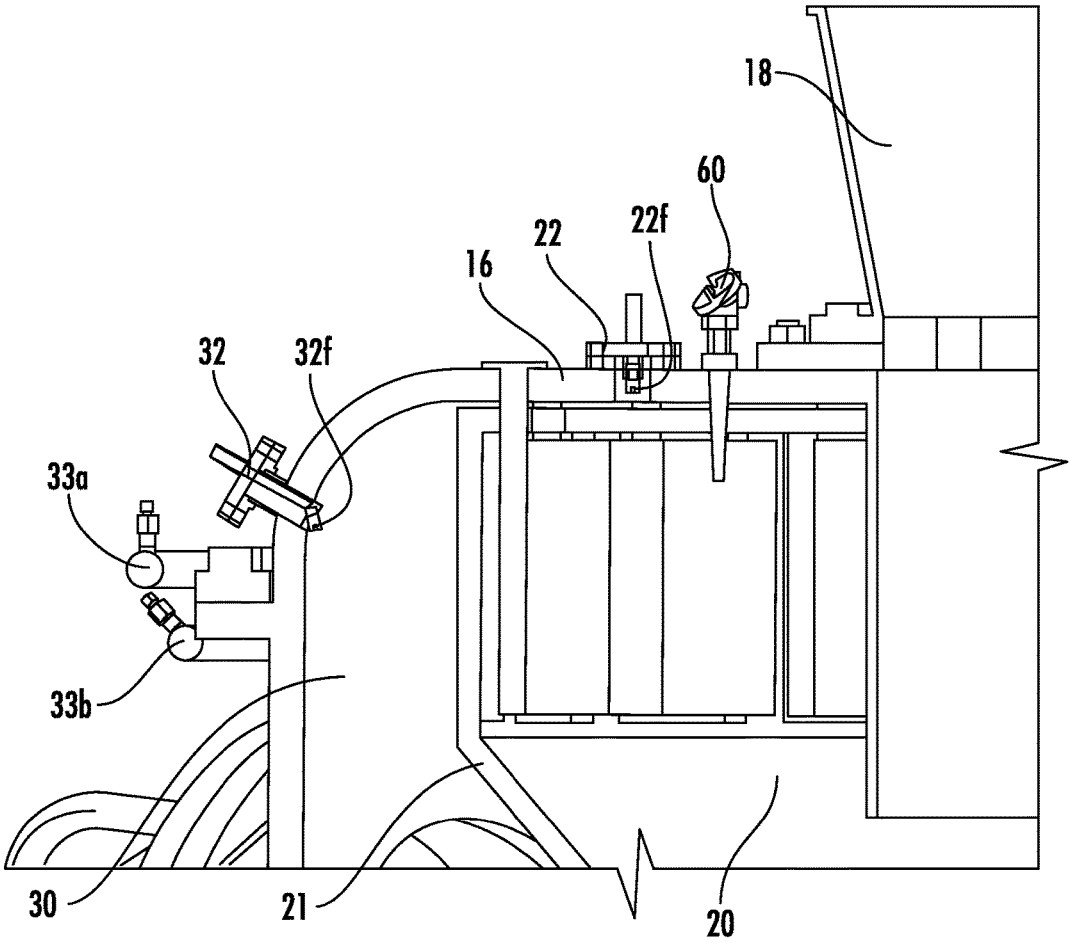
FIG. 19 is a partial cross sectional view of the system of FIG. 1.

A programmable logic controller (PLC) and a thermocouple 60 attached to the mill 12, as shown in FIG. 19, can be operatively connected to the solution delivery system such that the fire suppression solution can be delivered at varying intervals and at varying flow ranges to the nozzle assemblies 22, 32, 42 depending on the temperature in the mill 12. In addition, the flow of suppression solution can be modulated.

The system 10 can control high mill outlet temperature excursions by regulating the outlet temperature. This can be particularly important when hot and cold air dampers fail to control the mill outlet temperature satisfactorily and/or when high mill outlet temperatures are caused by circumstances outside of an operator's control, such as interruptions in raw coal feed. When the thermocouple 60 detects high temperatures from the coal outlets 18, the solution delivery system is triggered to deliver suppression solution to the nozzles 22, 32, 42. The nozzles 22, 32, 42 disperse suppression solution "S" in the mill 12, thereby lowering the temperature of the fuel/air mixture exiting the outlets 18.

Carbon Monoxide (CO) monitoring equipment can be installed in the mill outlets 18. Not all fires and puffs are preceded by a measureable CO spike, and not all fires and puffs are preceded by a measurable temperature excursion. By having both CO and temperature monitoring equipment, the likelihood of the onset of a fire going undetected is greatly reduced.

The system 10 incorporates mill outlet temperature management and continuous encapsulation of combustibles. The system 10 operates continuously while the mill 12 is in service, and pro-actively manages temperatures in the mill 12 to reduce the chance of a complete shut down due to a major event.

The system 10 includes a seal air distribution subsystem for delivering atmospheric air at high pressure to the nozzles 22, 32, 42. As shown in FIG. 7, the seal air distribution system can be comprised of classifier zone seal air manifolds 25 connected to the classifier zone nozzle assemblies 22 by piping 80, and grinding zone manifolds 35 are connected to the grinding zone nozzle assemblies 32 by piping 80. An underbowl/primary air seal manifold 45 is connected to the primary air duct nozzle assemblies 42.

The seal air distribution system draws in ambient air, and delivers it at high pressure to the nozzle assemblies 22, 32, 42. The pressurized air keeps the nozzle assemblies 22, 32, 42 clean, and the nozzle assemblies 22, 32, 42 disperse the air to help prevent contamination of the interior of the mill 12.

Figure 8:
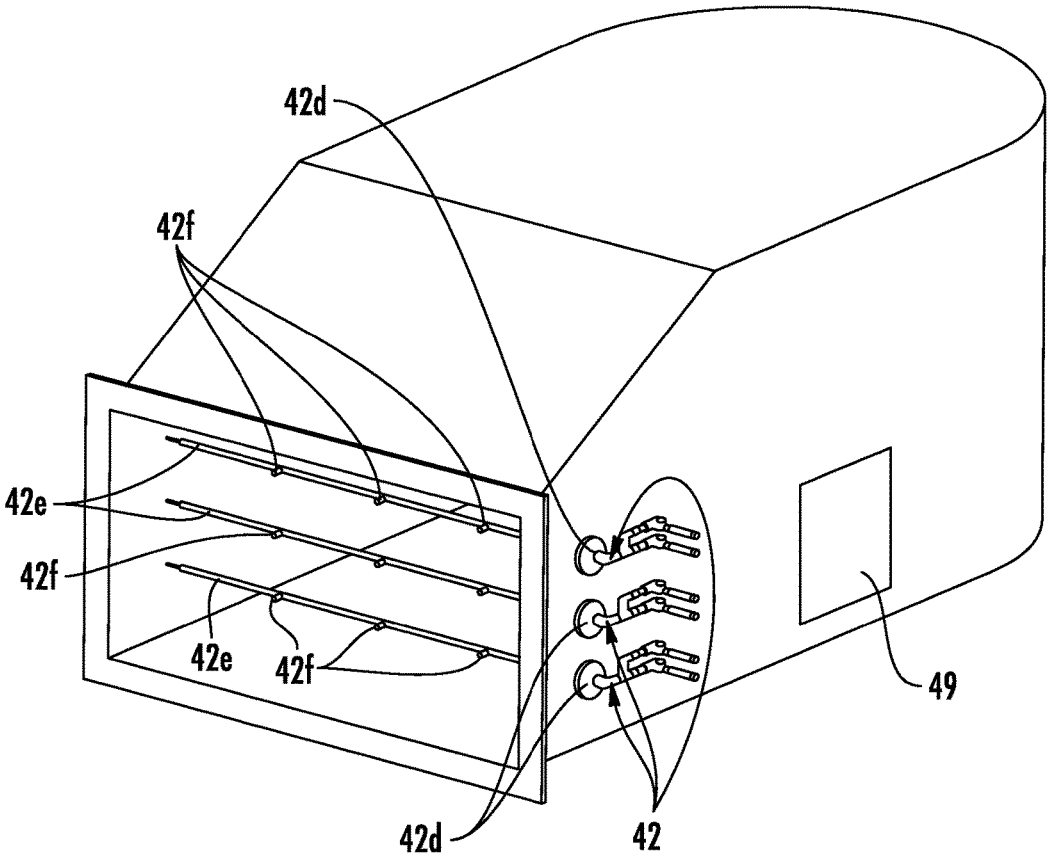
FIG. 8 is a partial perspective view of the system of FIG. 1.
Figure 9:
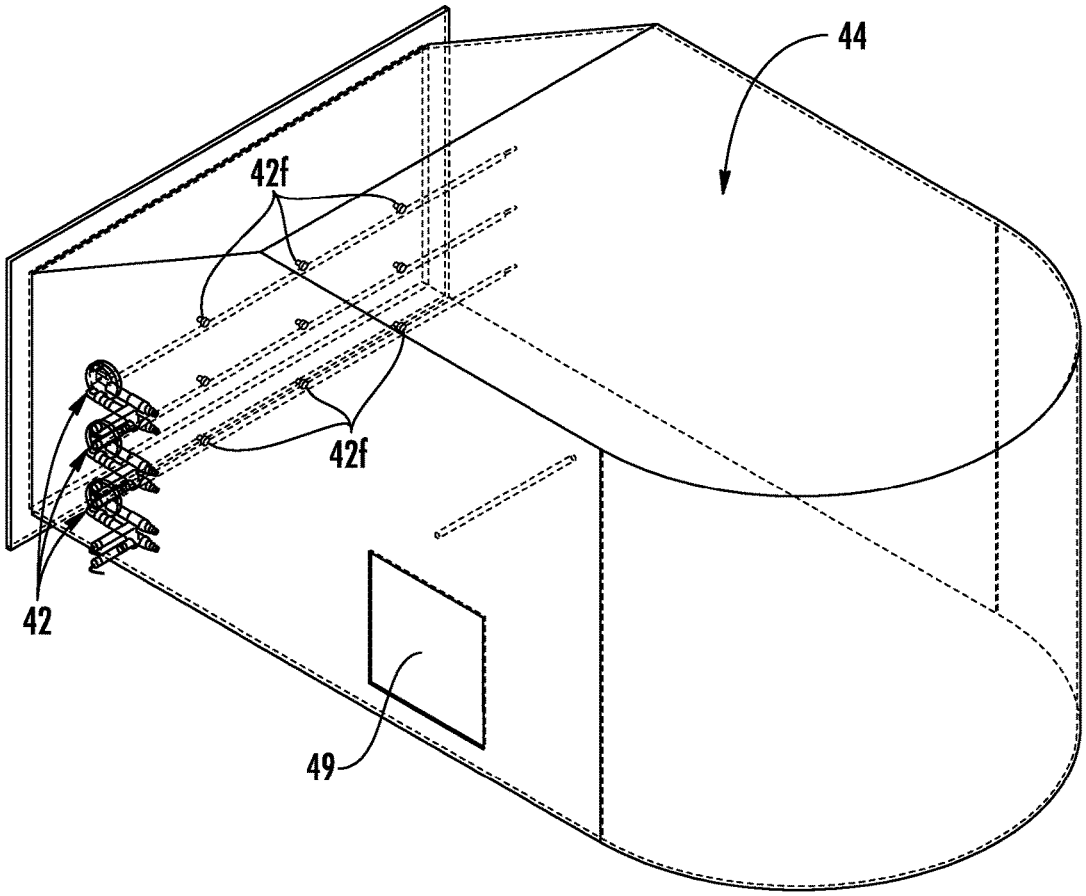
FIG. 9 is another partial perspective view of the system of FIG. 1.
Figure 10:
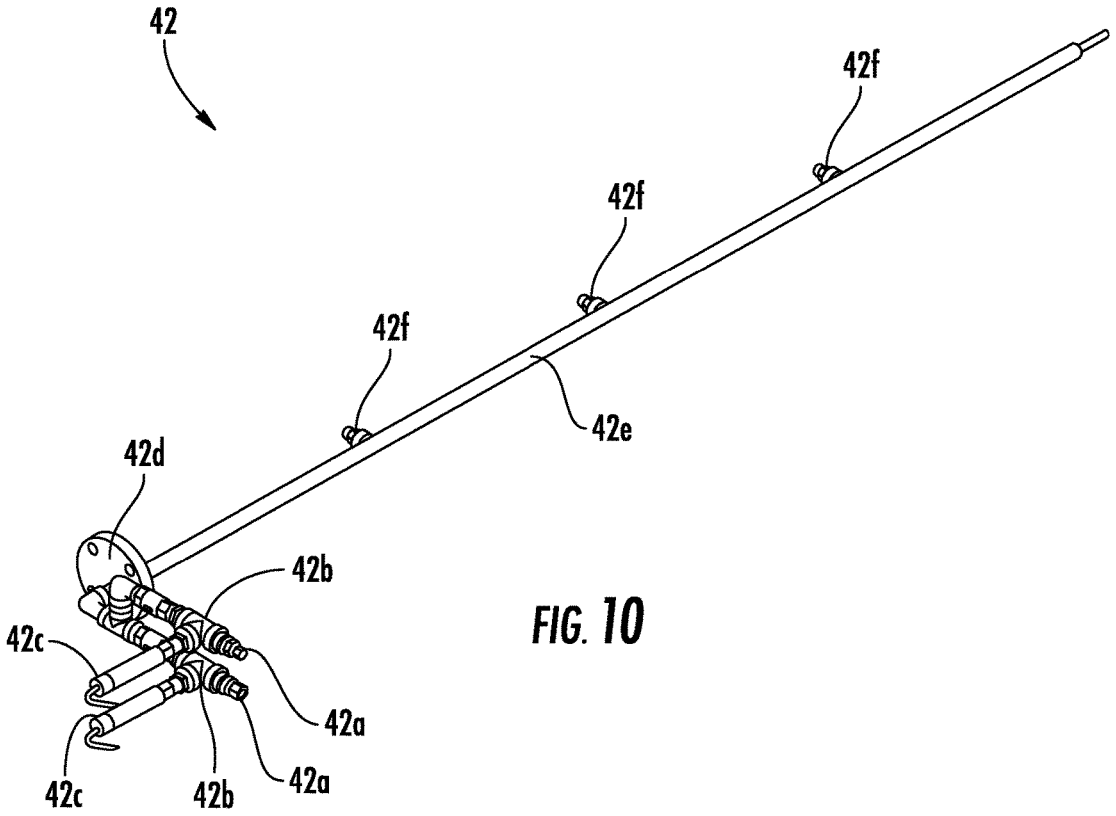
FIG. 10 is a perspective view of a primary air duct nozzle assembly according to a preferred embodiment of the invention.
Figure 11:
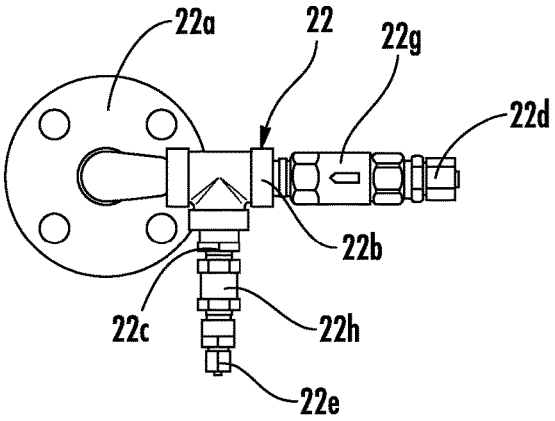
FIGS. 11-14 are various perspective views of a classifier zone nozzle assembly according to a preferred embodiment of the invention.
Figure 12:
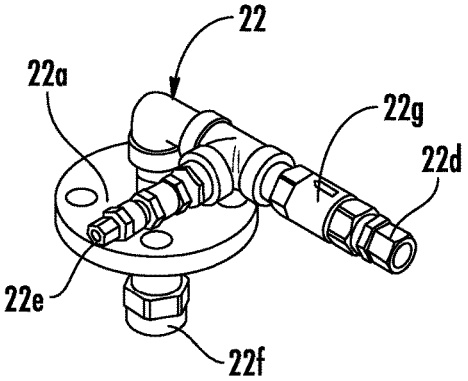
Figure 13:
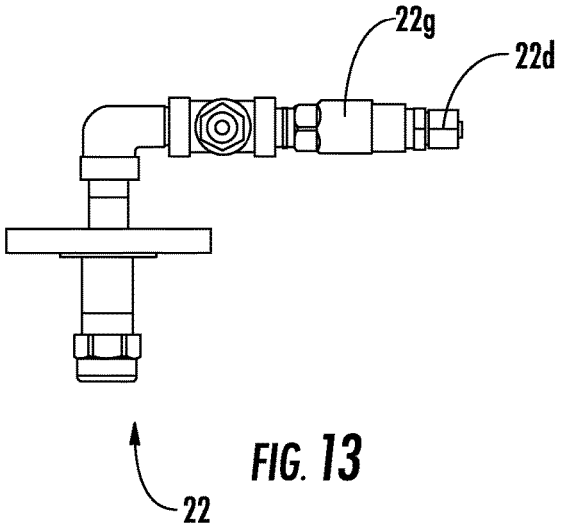
Figure 14:
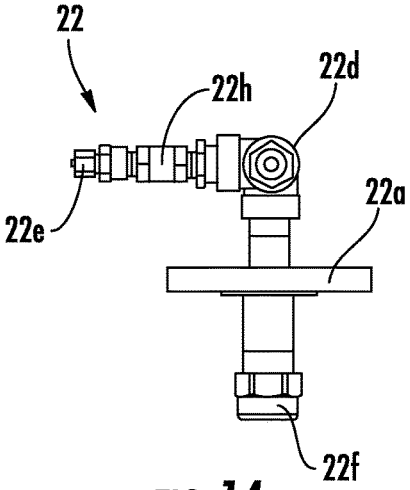
Figure 15:
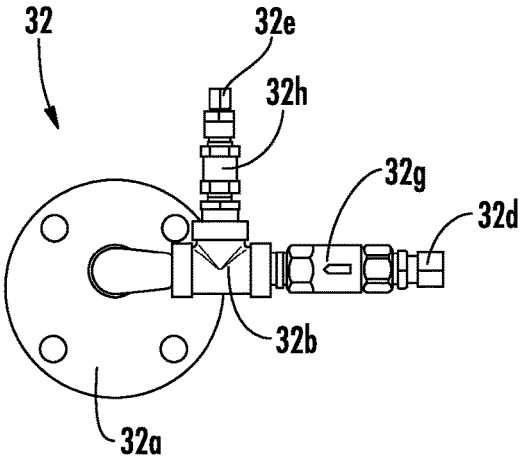
FIGS. 15-18 are various perspective views of a grinding zone nozzle assembly according to a preferred embodiment of the invention.
Figure 16:
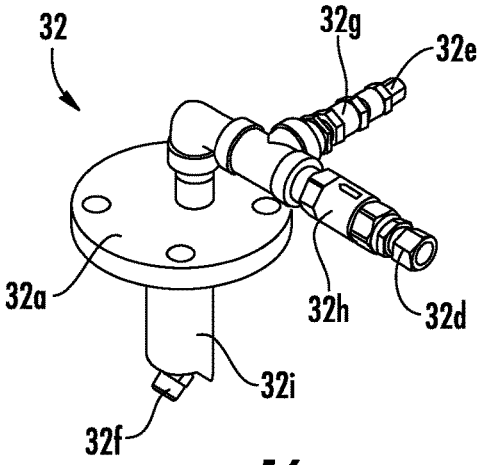
Figure 17:
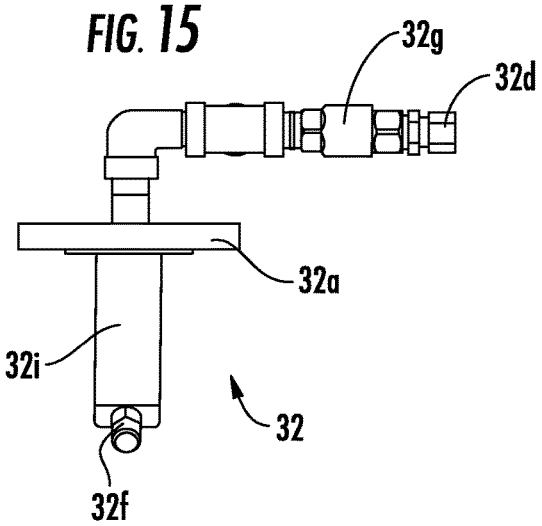
Figure 18:
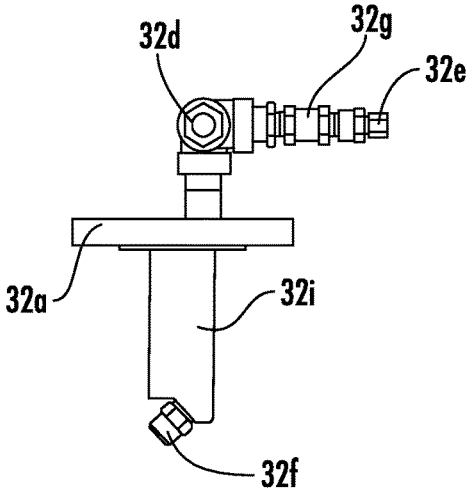

As shown in FIGS. 8 and 9, three primary air inlet zone nozzle assemblies 42 are mounted in the primary air duct 44. As shown in FIG. 10, each primary air zone assembly 42 comprises a pair of NPT adapters 42*a* joined to a pair of air/solution check valves 42*c* by NPT fittings 42*b* that are connected to a flange mount cap 42*d*. The flange mount cap 42*d* is mounted to the outside of the primary air duct 44, and a nozzle wand 42*e* extends from the opposite side of the mount cap 42*d*. Three fine mist, low flow nozzles 42*f* are connected to the wand 42*e*. The nozzles 42*f* can be connected to the wand by NPT half couplings, or other suitable connection means. One of the adapters 42*a* can be connected to the seal air distribution system, and the other adapter 42*a* can be connected to the solution delivery system. A flow switch is connected to the solution inlet, and detects when a nozzle 42*f* is eroded. Another flow switch is connected to the air inlet, and detects when a nozzle 42*f* is plugged up.

FIGS. 11-14 illustrate a preferred construction of the classifier zone nozzle assemblies 22. As shown in FIGS. 11-14, each classifier zone nozzle assembly 22 can be comprised of a pair of NPT to tube fittings 22*d*, 22*e*. One tube fitting 22*d* connects to the solution delivery system, and the other fitting 22*e* connects to the seal air distribution system. The solution inlet fitting 22*d* is connected to a solution side check valve 22*g*, and the seal air inlet fitting 22*e* is connected to an air side check valve 22*h*, which is connected to a Ten NPT adapter 22*c*, which connects to a NPT threaded tee fitting 22*b*. The tee fitting 22*b* connects the solution inlet 22*d* and the seal air inlet 22*e* to a pipe flange mounting cap 22*a*. A high flow, fine mist nozzle 22*f* positioned on the opposite side of the mounting cap 22*a* can be connected to the tee fitting 22*b* by an NPT threaded elbow. The mounting cap 22*a* is mounted on the mill 12, with the solution and seal air inlets 22*d*, 22*e* positioned exterior to the mill 12, and the nozzle 22*f* extending into the interior of the mill 12, as shown in FIGS. 19 and 20.

FIGS. 15-18 illustrate a preferred construction of the classifier zone nozzle assemblies 32. As shown in FIGS. 15-18, each classifier zone nozzle assembly 32 can be comprised of a pair of NPT to tube fittings 32*d*, 22*e*. One tube fitting 32*d* connects to the solution delivery system, and the other fitting 32*e* connects to the seal air distribution system. The solution inlet fitting 32*d* is connected to a solution side check valve 32*g*, and the seal air inlet fitting 32*e* is connected to an air side check valve 32*h*, which are connected to a NPT tee fitting 32*b*. The tee fitting 32*b* connects the solution inlet 32*d* and the seal air inlet 32*e* to a pipe flange mounting cap 32*a*. A machined cylindrical nozzle body 32*i* positioned on the opposite side of the mounting cap 32 can be connected to the tee fitting 32*b* by an elbow fitting. A low flow, medium droplet, full cone nozzle 32*f* is connected to the nozzle body 32*i*. The mounting cap 32*a* is mounted on the mill 12, with the solution and seal air inlets 32*d*, 32*e* positioned exterior to the mill 12, and the nozzle 32*f* extending into the interior of the mill 12, as shown in FIGS. 19 and 20.

The seal air distribution system can provide a continuous stream of air to each of the nozzle assemblies 22, 32, 42 to prevent plugging of the nozzles 22, 32, 42. When solution is supplied to the mill 12, a single air valve (solenoid type) is closed halting air supply to all nozzles 22, 32, 42. Check valves 22*h*, 32*h*, 42*c* on the air side of the nozzle assemblies 22, 32, 42 keeps solution from running up into the air lines. When the air supply is shut off, the flow switch on the air supply side indicates when a nozzle assembly 22, is plugged. Because there is a flow switch per nozzle assembly 22, 32, 42 the exact nozzle that is plugged may be indicated.

Higher than normal pressure in the solution delivery lines typically indicates a partially plugged nozzle. The system 10 may continue to operate, but the spray effectiveness will be compromised. Pressure is measured per spray zone. As such, the particular nozzle that is partially plugged is not known, however, the spray zone that the particular nozzle resides in is indicated. However, if seal airflow to a particular nozzle drops below the seal air flow switch threshold, the exact nozzle that is partially or completely plugged will be indicated. Low pressure in the solution delivery lines typically indicates a worn nozzle. As the nozzle wears, due to the abrasion of swirling coal dust, the orifice diameter expands. An expanded orifice diameter equates to higher than normal flow at a given pressure. Once flow goes above the solution flow switch threshold, the eroded nozzle will be indicated. Nozzle assemblies 22, 32, 42 can be easily replaced by disconnecting air and water lines and removing the nozzle assembly 22, 32, 42.

While the system 10 is described above and shown in the drawings as being used in a Bowl type pulverizer mill, the system 10 is not so limited. The system 10 can be incorporated into varying pulverizer designs, such as Attrita, Ball Tube, CE Deep Bowl, CE Shallow Bowl, EL, Dooson Babcock E-Type, MBF, Ball and Race, and MPS pulverizers.

The mill protection system 10 is capable of not only responding to existing fires, but can also address many of the issues that lead to mill fires and explosions. The system 10 addresses these issues with advanced sensing equipment, carefully placed spray nozzles of various designs, utilization of an effective encapsulation/wetting agent and high speed reaction to early indications of mill issues. The system 10 can spray at varying densities to address issues ranging from high outlet temperatures to high levels of carbon monoxide (CO). The system 10 also prevents possible issues by removing combustibles in the mill 12 after a shutdown or mill trip and rapidly cooling the mill 12, thereby eliminating issues related to hot restarts and allowing personnel to enter the mill for inspection after an event or for regular maintenance. At its lowest flow rate, the system 10 fills the vessel with a fine mist, thereby assisting in cooling and encapsulating combustible dusts without agitation. At higher flow rates, the system 10 can fully control mill temperatures without the assistance of coal flow or damper position changes. At the maximum flow rate, the system 10 can fully deluge the mill 12, flooding the bowl and underbowl and washing coal out of the pulverizer. The coal dust can be carried away by the pyrites removal system. The system 10 can have a maximum spray density of greater than 0.25 $gpm/ft^2$ so that a fire can be quickly suppressed. The system 10 can be equipped to address fires in ancillary equipment via external spray headers.

The system 10 can include an independent, highly sensitive thermocouple at the mill outlet for obtaining an accurate mill temperature. When the mill 12 is at a steady state, this temperature is compared to existing temperature measurement elements also located at the mill outlet in order to verify that the temperature the system is responding to is accurate. The rapid response of this element means that the system 10 responds to increases in temperature quickly, often before plant control systems detect a change. This additional element also provides supplementary data for troubleshooting mill operating parameters. In the event of a temperature spike, the system 10 can initiate spraying in 250 milliseconds or less. In addition to responding to temperature excursions, the system 10 can also utilizes a fulltime, continuous carbon monoxide (CO) monitoring subsystem, which unlike CO monitors known in the art, has one sensor and gas extraction system per mill. Known CO monitors extract gas samples from all mills to a single sensor, one at a time. For larger units with a high mill count and long sample line runs, this can mean that an increase in CO level may not be indicated for several minutes after the initiation of combustion.

The mill protection system 10 can have various modes of operation that initiate based on the current operating mode of the attached pulverizer. If the mill 12 is in startup mode or running at a steady state, the system 10 is in temperature excursion mode. In this mode the system 10 sprays at varying densities based on indicated temperature and rate of temperature rise. At a temperature just above the normal mill operating temperature setpoint, the system 10 sprays at a low flow rate in the primary air inlet zone (PAZ) 43. As temperature increases, the system sprays at higher flow rates in the primary air zone 43, the grinding zone (GZ) 30 and in the classifier cone (CZ) 20. In this mode of operation, the system 10 is capable of mitigating temperature excursions whether due to a reduction or loss of coal feed or a stuck or slowly-responding hot or cold air damper. At its highest flow rate, the system 10 is capable of delivering enough moisture to the vessel to maintain outlet temperatures at or below the normal operating temperature of the pulverizer. If coal flow completely stops, the mill temperature is maintained at safe levels allowing additional time to restore flow. If dampers stick due to a mechanical or electrical malfunction, the system 10 can maintain safe temperatures without tripping the mill 12. Again, in this situation, this provides additional time to either correct the damper issue or bring the mill 12 offline safely. Because the system 10 can maintain mill temperature independently, operator errors do not generate a potential for catastrophic events. Sudden spikes in temperature due to starting coal feed late or introducing hot airflow early are mitigated by the system 10.

When the mill 12 is being shutdown, the system 10 begins to introduce a fine mist spray in the primary air zone 43 when the feeder is stopped. This assists in cooling the mill 12 while the remaining coal is swept out with tempering air. When the hot air damper and/or gate are completely shut and low mill amps indicate that the grinding zone 30 has been completely swept out, the system 10 deluges the mill 12, completely cooling the mill 12 and washing out combustibles, which are removed via the pyrites removal system. The outlet temperature is checked at the end of this deluge. If the temperature is above setpoint, the system 10 continues to spray until a safe temperature is attained. With the mill 12 cooled to a safe temperature and completely washed out, the mill 12 is safe on the next start. Also, there is no coal left to be heated to ignition and no heat in the mill 12 to do so. For a period of two hours after the mill 12 is stopped, the system 10 monitors mill outlet temperature. If this temperature rises above a predetermined setpoint, a short spray sequence drops the temperature back down. No operator intervention is required.

In the event of a mill trip, the system 10 immediately introduces spray. Similar to the shutdown sequence, the mill 12 is rapidly cooled and combustibles are washed out through the pyrites system. This method of clearing the mill 12 of coal greatly reduces the risks associated with hot restarts. The sequence completes in two minutes and it is recommended that the operator run the mill with tempering air for one minute to dry out the mill prior to starting. In the event that the mill 12 is not immediately restarted, the system 10 monitors mill outlet temperatures and responds with a spray sequence if temperatures rise above the setpoint temperature.

Several manual modes of operation are possible with the system 10. Spray may be initiated in any spray zone 20, 30, 43 either from the control room or using hand/off/auto (HOA) switches at the main control panel. Spray media can be either pure water or a solution of water and encapsulation/wetting agent. With manual operation, the system 10 can be used to encapsulate combustibles and assist in cooling by activating the fine mist nozzles in the pulverizer inlet/under bowl zone 40 and the classifier zone 20. This method of manual operation can be useful as an extra safety precaution prior to entering the mill 12 for inspection. If a fire is discovered in the mill 12, either by direct observation of burning material or as indicated by elevated CO levels, spray may be manually activated by initially activating the fine mist spray nozzles in the PAZ 43 and CZ 20 and then stepping up spray intensity by adding a second, high flow zone in the PAZ 43. A full deluge may also be performed by initiating all spray zones: two sets of nozzles in the PAZ 43, two sets in the GZ 30 and the set of nozzles located in the classifier cone (CZ) 20. Beyond directly activating spray zones, any of the automatic modes of operation can be manually forced. This can be useful for washing out the mill 12 by forcing the loaded mill trip sequence.

According to another preferred embodiment, the system 10 can include a fourth set of suppression solution injection points. As shown in FIGS. 23-27, the pulverizer mill 12 includes a plurality of nozzle assemblies 48 adapted and positioned for spraying suppression solution into the plenum chamber 41 of the under bowl zone 40. The plenum chamber 41 refers to the area below the grinding zone 30 where pulverization of coal occurs. As such, the pulverizer 12' has four groups of injection nozzle assemblies-classifier zone nozzle assemblies 22, grinding zone nozzle assemblies 32, primary air zone nozzle assemblies 42, and under bowl zone nozzle assemblies 48.

Figure 23:
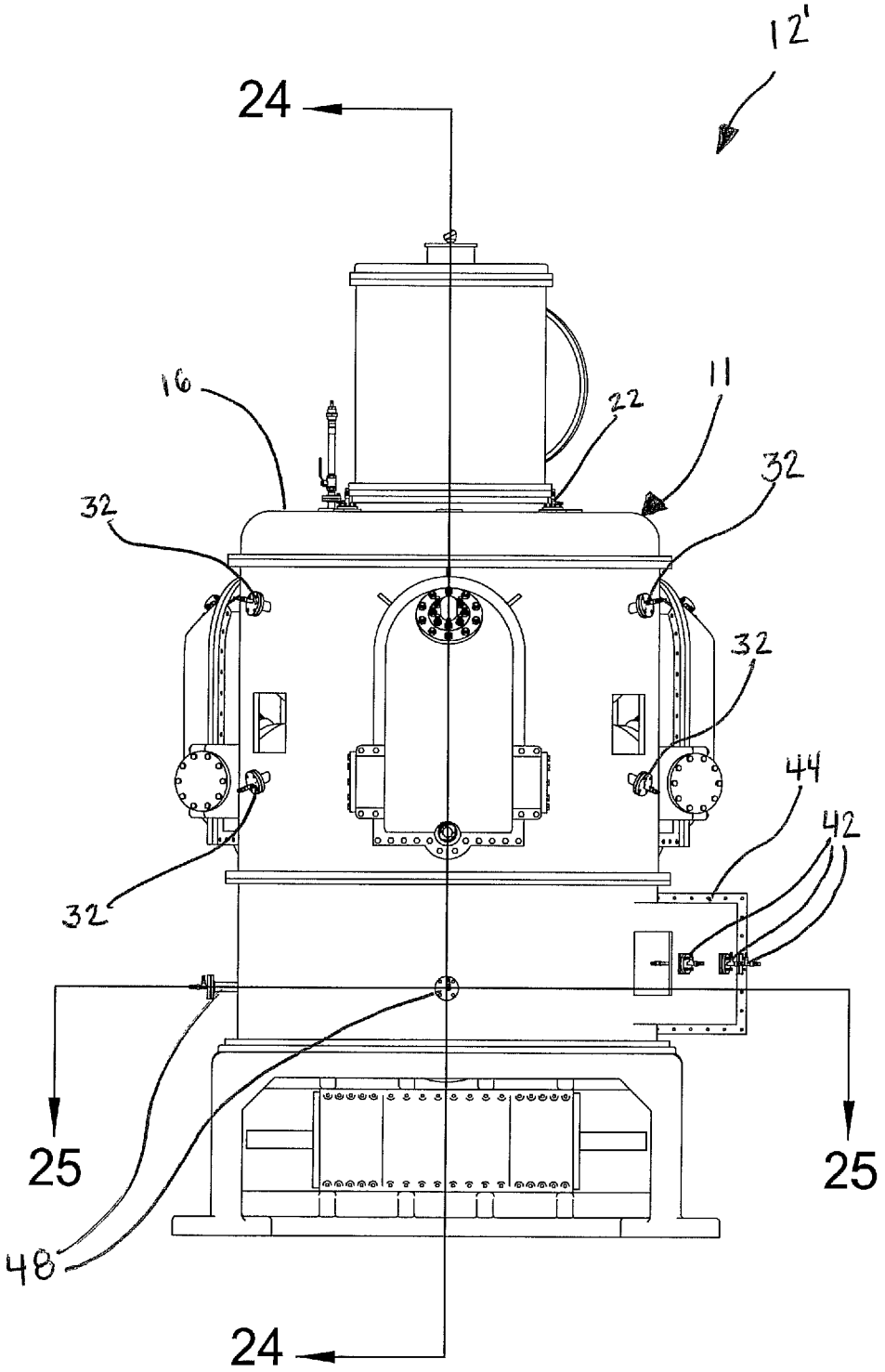
FIG. 23 is a perspective view of a pulverizer mill according to another preferred embodiment of the invention.
Figure 24:
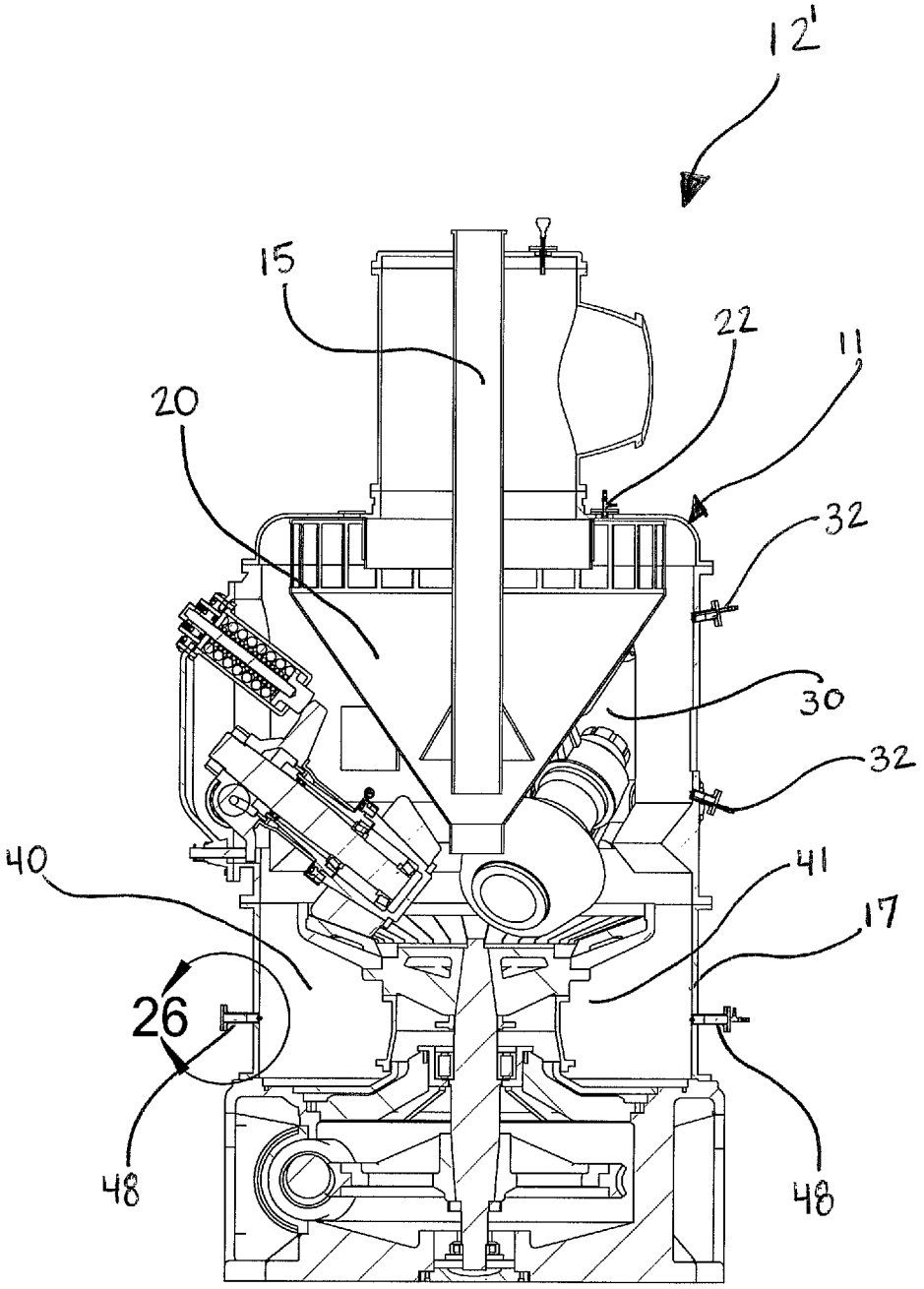
FIG. 24 is a cross-sectional view of the pulverizer mill of FIG. 23, taken along line 24 in FIG. 23.
Figure 25:
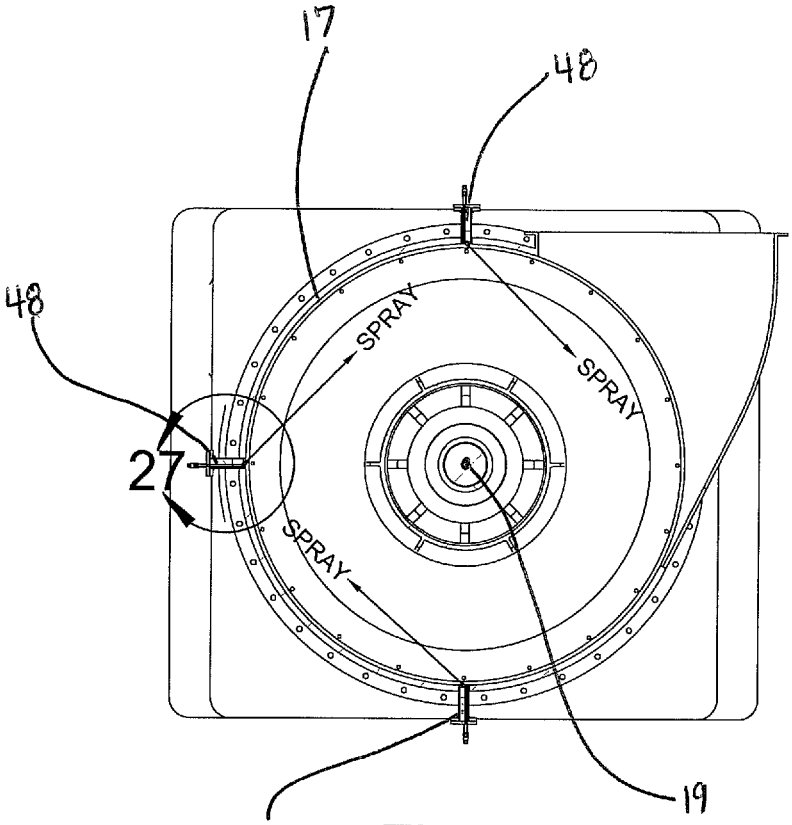
FIG. 25 is a cross-sectional view of the pulverizer mill of FIG. 23, taken along line 25 in FIG. 23.

FIG. 24 is a cross-sectional view of the pulverizer mill of FIG. 23, taken along line 24 in FIG. 23 The under bowl nozzle assemblies 48 are mounted on the sidewall 17 of the mill housing 11, as shown in FIGS. 23 and 24. The nozzle assemblies 48 are positioned in a circular arrangement as shown in FIG. 25. Preferably, there are three or four plenum chamber nozzle assemblies 48. In the majority of pulverizer mills, four plenum nozzle assemblies 48 is preferred. Alternatively, three nozzle assemblies 48 is preferred when the pulverizer mill is smaller, requires less water flow and full coverage and sufficient flow can be achieved with three nozzle assemblies 48.

FIG. 24 is a cross-sectional view of the pulverizer mill of FIG. 23, taken along line 24 in FIG. 23 These nozzle assemblies vector water into the high temperature areas of the pulverizer 12' where fires are most likely to occur. According to an embodiment of the invention, there can be four under bowl zone nozzle assemblies 48 spaced ninety degrees apart around the circumference of the pulverizer or mill housing 11. Alternatively, there can be three under bowl nozzle assemblies 48 spaced 120 degrees apart.

The plenum chamber 41 can vary in size, configuration and nomenclature depending on the pulverizer original equipment manufacturer, type, model number and other factors. The plenum chamber 41 is also known as "the under table area" or "primary air windbox." The plenum chamber 41 is where heated primary air enters the coal pulverizer 12 and flows through an annular opening, known as a vane wheel or pulverizer throat, into the grinding zone 30. The primary air provides heat to remove coal moisture, facilitate proper circulation of coal through the grinding zone 30 and classifier zone 20, and to serve as a transport medium to remove the pulverized coal from the pulverizer 12' and transport the coal to the burners of a coal fired furnace.

Figure 26:
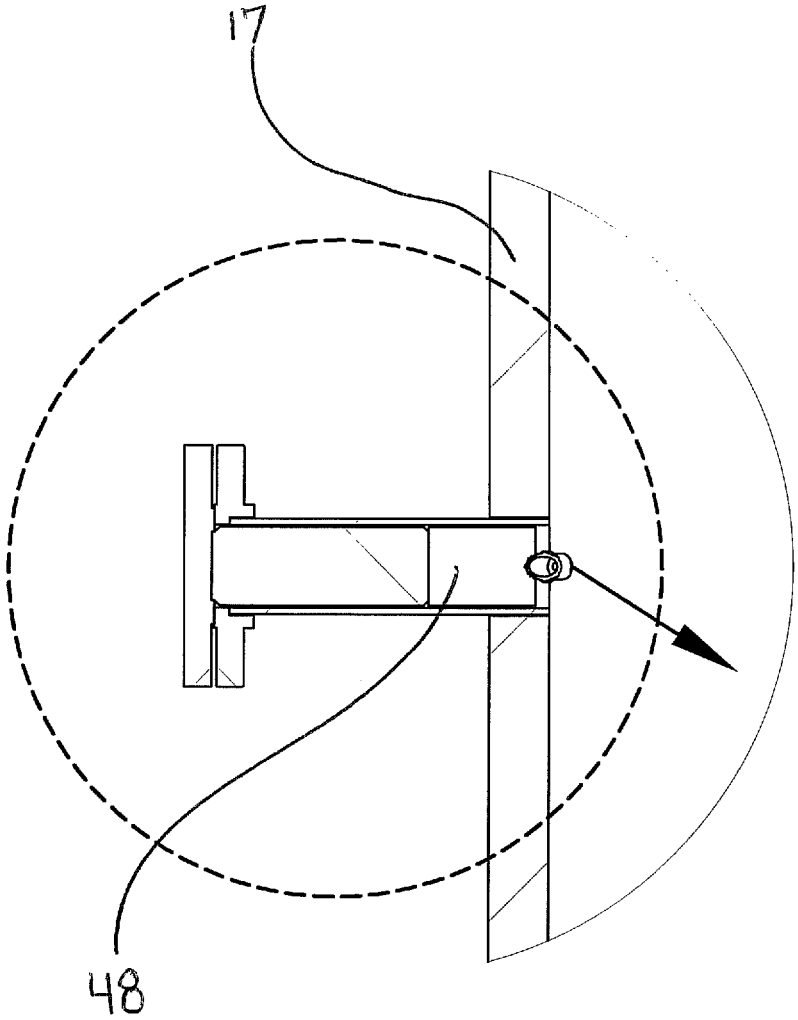
FIG. 26 is a partial enlarged view of the pulverizer mill of FIG. 23, taken along line 26 in FIG. 24.
Figure 27:
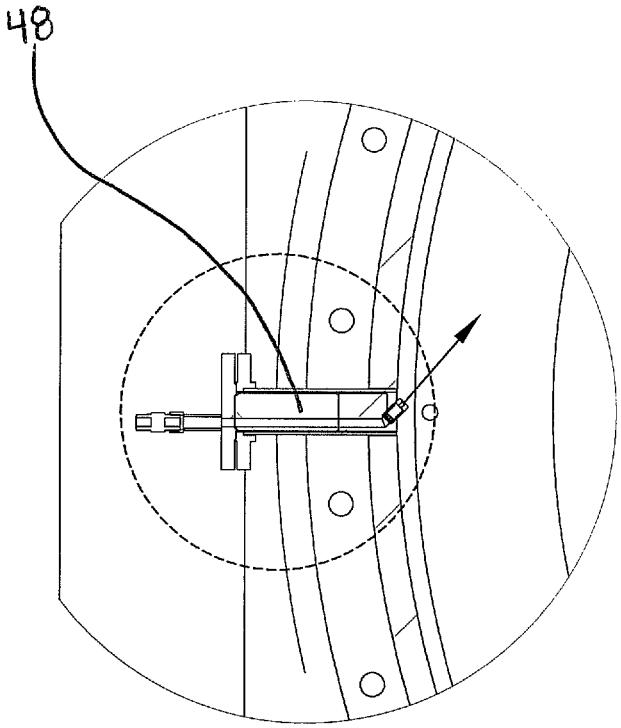
FIG. 27 is a partial enlarged view of the pulverizer mill of FIG. 23, taken along line 27 in FIG. 25.

The nozzle assemblies 48 spray suppressant solution in a tangential pattern. The nozzle assemblies 48 are positioned to spray solution along a tangent of an annular center line between the sidewall 17 of the pulverizer housing 11 and the center 19 of the pulverizer housing 11, where the shaft housing is located, as shown in FIG. 25. This creates a swirling action of fluid on the floor to dislodge and sweep coal and other debris out of the mill 12' while at the same time cooling hot material and extinguishing burning or smoldering coal. The nozzle assemblies 48 can be positioned to spray downwardly at an angle of about forty-five degrees, as shown in FIG. 26, and at a horizontal angle of about forty-five degrees, as shown in FIG. 25.

The nozzle assemblies 48 have a downward orientation to wash away coal and any burning combustible material out of through the pyrite/tramp metal chute while at the same time suppressing any fires or high temperature areas. Any burning or smoldering coal settles on the floor of this space. The downward orientation of the nozzle assemblies 48 can be varied based on mill configuration and size. The nozzle assemblies 48 are positioned to spray suppressant solution along a tangent of a circle that divides the annulus between the mill housing sidewall 17 and shaft housing 19.

The heated air in the plenum chamber 41 under the grinding zone 30 can range between 250 and 700 degrees Fahrenheit depending on various factors. A large number of coal burning facilities utilize high moisture subbituminous coals. Due to the high moisture and a large amount of heat needed to dry the high moisture coal, the temperature of the air entering the plenum chamber 41 under the grinding zone 30 is of very high temperature, generally between 500 and 700 degrees Fahrenheit during steady state operation.

As a result of this high temperature, any coal particles that fall through the annular opening of the vane wheel or pulverizer throat can be heated to ignition temperature and begin to burn. Also, the slow trickle of coal particles into this plenum chamber can result in accumulations of coal that is combustible in this high temperature area and develop into fires of significance that can cause damage or serve as an ignition source that can be carried through to other parts of the coal pulverizer 12.

During pulverizer start-up, shutdown or during interruptions in raw coal feed to the pulverizer 12', high air to fuel ratios exist. Because the high moisture coal has a high capacity to absorb heat, interruptions in coal flow allow high temperature air normally constrained to the under bowl area 40 to migrate into the grinding zone 30 where combustible coal dust is being actively fluidized. The combination of high air to fuel ratio, small particle sizing of the coal and an ignition source inside the pulverizer 12' can result in an explosion or "puff". These explosions can damage the pulverizer 12' and can injure personnel in the immediate area if the force of the explosion allows hot air, hot gases or flying debris to be ejected away from the pulverizer 12' if any part of the pulverizer 12' or heated air ducting to the pulverizer 12' ruptures as a result of the explosion.

The plenum chamber nozzle assemblies 48 suppress fires and/or burning material that develops in the under bowl area 40 that can be detected by various methods. The nozzle assemblies 48 rapidly cool the hot primary air and other hot surfaces when the pulverizer 12' experiences high temperature excursions as a result of interruptions in coal flow or other factors. This complements spraying zones in other parts of the coal pulverizer 12' to ensure that high temperature excursions do not occur anywhere inside the coal pulverizer 12' or primary air ducting 44 immediately upstream of the coal mill.

The configuration, positioning and selection of nozzles allows for some vectoring and swirling of solution to the floor of the plenum chamber 41 to aid in the removal of combustible material from the mill 12' which is typically accomplished by two scrapers or plows that force the material through a small opening into a reject chute and-or hopper.

The plenum chamber nozzle assemblies 48 suppress combustible dust that may be in suspension and wash accumulations of the combustible dust (coal) from this high temperature area. Spraying in other areas of the mill 12' can also be coordinated to prevent combustible dust or slurry of water/solution entering the primary air ducting upstream of this hot air plenum.

The under bowl zone nozzle assemblies 48 provide higher water flows that create a swirling action of water to effectively wash away combustible coal dust from this high temperature area. Full cone sprays vectored strategically are arranged to douse and extinguish any burning material.

The underbowl zone nozzle assemblies 48 can be manually triggered if there is visual evidence of sparks, embers or smoldering coal that can be seen discharging through the reject chute. Carbon monoxide probes can be positioned in the underbowl zone 40 to serve as an indication of burning coal or other debris in the underbowl zone 40.

Fluid flow to all of the nozzle assemblies 22, 32, 42, 48 can be controlled by a programmable logic controller and a solenoid valve to each set of nozzle assemblies 22, 32, 42, 48. Rather than being merely on or off, the programmable logic controller has different control algorithms for different operating modes for different conditions. Each of the nozzle assemblies 22, 32, 42, 48 can be programmed to spray in a specific sequence and/or in cyclical bursts depending on the operating mode and other feedback from instrumentation. The spray zones are also coordinated and sequenced in a logical way. Different nozzle assemblies can have different spray patterns and flow rates. For example, the primary air duct nozzle assemblies 42 can be low flow and small droplet sizing to supply a "fog or mist", the primary purpose of which is to suppress temperature when mill outlet temperature is higher than set point.

Preferably, the spray patterns and flow rates for the nozzle assemblies 22, 32, 42, 48 can be the following. The classifier zone nozzle assemblies 22 have a fine mist spray pattern and a flow rate of 6.8 gallons per minute (GPM) at eighty pounds per square inch (psi). The grinding zone nozzles 32 have a full cone spray pattern and a flow rate of 5.54 gallons per minute (GPM) at eighty pounds per square inch (psi). The plenum chamber nozzles 48 have a fan type spray pattern, and a flow rate of 5.66 gallons per minute (GPM) at eighty pounds per square inch (psi). The primary air zone nozzles 42 have a fine mist spray pattern, and a flow rate of 0.35 gallons per minute (GPM) at eighty pounds per square inch (psi).

All spray nozzle assemblies 22, 32, 42, 48 work in conjunction to control mill outlet temperature to set-point as a secondary control to the primary temperature control loop that controls a pulverizers hot and tempering/cold air dampers to control pulverizer outlet temperature. The nozzles 22, 32, 42, 48 are also active when the pulverizer 12' is in service and out of service, and other types of systems operate exclusively during start-up and shutdown sequences.

Each of the nozzle assemblies 22, 32, 42, 48 can include a flow meter that provides feedback to the controls with alarms for high flow (indicative of a worn nozzle) or low flow (indicative of plugging or a flow obstruction).

Each of the nozzle assemblies 22, 32, 42, 48 can be connected to two supply lines. One supply line provides the solution of water and chemical agent, and the second supply line provides seal or purging air that allows air to flow through the nozzle when it is out of service (no solution flow).

The system 10 can monitor and manage internal pulverizer outlet temperature after a pulverizer has been taken out of service intentionally or following a forced trip. After shutdown, the pulverizer temperature can increase significantly, and any residual coal that remains anywhere in the pulverizer can begin to smolder and burn. This burning material can evolve into a fire and or serve as an ignition source when the pulverizer is restarted.

The system 10 can include control algorithms to monitor the internal temperature of the pulverizer 12' while it is out of service. If internal temperatures begin to increase, the control algorithm's "temperature excursion mode" spraying sequence is started and ensures that internal temperatures of the pulverizer 12' do not exceed a selected temperature, such as 140 F.

In the event of temperature or CO excursions, a few short bursts of suppression solution can be sprayed into the classifier zone 20, and under bowl zone 40. If the temperature or CO levels continue to rise, longer bursts of solution can be sprayed into the classifier zone 20, grinding zone 30, and underbowl zone 40. At a temperature just below the blast gate set point, all spray zone nozzle assemblies 22, 32, 42 spray continuously. After the blast gate closes, solution is continuously sprayed in all zones 20, 30, 40 in order to completely cool the interior of the mill 12, and encapsulate combustibles.

In the event of a coal feed interruption, the feeder trips or other indication of interrupted coal feed into the mill 12 triggers intermittent bursts of solution that keep the temperature of the mill 12 under control until the blockage is cleared. Suppression solution is sprayed into the grinding zone 30 and under bowl zone 40.

At start-up of the mill 12, the system 10 sprays solution into the classifier zone 20, grinding zone 30 and underbowl zone 40 in frequent bursts that taper off as temperatures in the mill 12 stabilize. During shutdown, the system 10 sprays suppression solution into the classifier zone 20, grinding zone 30 and underbowl zone 40 initially in short, infrequent bursts that gradually increase in frequency. The shutdown cycle ends with a deluge of continuous solution flow from all nozzles in order to encapsulate combustibles in the mill internals. If the mill is taken offline for a long period of time, solution can be continuously sprayed to completely cool the mill 12 and encapsulate combustibles for maintenance purposes.

The system 10 can be set into a manual hand mode, in which individual spray zones 20, 30, 40 or entire mills can be sprayed with suppression solution at the direction of the operator. Reasons for manual operation can include observation of burning coal in the pyrite reject area, cooling the mill 12 prior to entering the confined space, encapsulating combustibles (effectively inerting) in the confined space of the mill 12 prior to maintenance, internal wash down either with solution or clean water by opening the solution bypass valve.

A pulverizer mill protection system and method of using same are described above. Various changes can be made to the invention without departing from its scope. The above description of the preferred embodiments and best mode of the invention are provided for the purpose of illustration only and not limitation—the invention being defined by the claims and equivalents thereof.

What is claimed is:

1. A pulverizer mill protection system comprising:

(a) at least one pulverizer mill comprising:

(i) a housing comprising an upper wall, a base, and a sidewall extending between the upper wall and the base, (ii) an inlet opening formed in the upper wall for receiving solid fuel therethrough, (ii) a classifying element positioned within the housing for classifying the solid fuel, wherein a classifier zone is defined by an area between the classifying element and the upper wall of the mill, (iii) a grinding element positioned within the housing downstream the classifying element for grinding the solid fuel, wherein a grinding zone is defined by an area outside of the classifying element, and (iv) a plenum chamber located within the housing below the grinding element;

(b) a fire suppression solution;

(c) classifier zone nozzle assemblies in communication with the fire suppression solution, and positioned within the housing to disperse the suppression solution within the classifier zone;

(d) grinding zone nozzle assemblies in communication with the suppression solution, and positioned within the housing to disperse the suppression solution within the grinding zone;

(e) plenum chamber nozzle assemblies in communication with the suppression solution, and positioned within the housing to disperse the suppression solution within the plenum chamber; and (f) a programmable logic controller operatively connected to the plurality of nozzle assemblies, wherein the programmable logic controller is programmed with a plurality of control algorithms instructing each of the nozzle assemblies to disperse suppressant solution at a selected interval, spray pattern and flow range in response to conditions in the pulverizer mill.

2. The pulverizer mill protection system according to claim 1, wherein the plenum chamber nozzle assemblies are positioned within the plenum chamber and disperse the suppression solution within the plenum chamber in a substantially swirling pattern.

3. The pulverizer mill protection system according to claim 1, wherein the housing is substantially cylindrical, and the plenum chamber nozzle assemblies are positioned in a substantially circular pattern.

4. The pulverizer mill protection system according to claim 3, wherein the plenum chamber nozzle assemblies spray suppressant solution downwardly at an angle of about forty-five degrees.

5. The pulverizer mill protection system according to claim 1, wherein the at least one pulverizer mill further comprises a primary air duct, and further comprising primary air duct nozzle assemblies in communication with the fire suppression solution and positioned within the primary air duct to disperse the suppression solution within the primary air duct.

6. The pulverizer mill protection system according to claim 1, wherein the classifier zone nozzle assemblies are mounted in a first circular array on the upper wall of the housing around the inlet opening above the classifying element, whereby the first set of nozzle assemblies disperse the suppression solution into the classifier zone, and the grinding zone nozzle assemblies are mounted on the upper wall in a second circular array proximate an outer edge of the upper wall, the second circular array circumscribing the first circular array and positioned outside of the classifier zone, whereby the second set of nozzle assemblies disperses the suppression solution into the grinding zone.

7. The pulverizer mill protection system according to claim 1, wherein each of the nozzle assemblies comprises a flow meter adapted for detecting a rate of flow.

8. The pulverizer mill protection system according to claim 1, wherein the classifier zone nozzle assemblies, the grinding zone nozzle assemblies and the plenum chamber nozzle assemblies disperse suppressant solution at varying spray patterns and flow rates.

9. The pulverizer mill protection system according to claim 8, wherein the classifier zone nozzle assemblies disperse suppressant solution in a fine mist spray pattern, the grinding zone nozzle assemblies disperse suppressant solution in a full cone spray pattern, and the plenum chamber nozzle assemblies disperse suppressant solution in a fan spray pattern.

10. A method for suppressing fires in pulverizer mills comprising:

(a) providing a pulverizer mill comprising a housing;

(b) providing a supply of a fire suppression solution;

(c) providing a plurality of nozzle assemblies, and operatively connecting the plurality of nozzle assemblies to the supply of fire suppression solution;

(d) positioning the plurality of nozzle assemblies in the pulverizer mill whereby the plurality of nozzle assemblies disperses fire suppression solution within the housing;

(e) providing a programmable logic controller and operatively connecting the programmable logic controller to the plurality of nozzle assemblies; and (f) programming the programmable logic controller with a plurality of control algorithms instructing each of the nozzle assemblies to disperse suppressant solution at a selected interval, spray pattern and flow range in response to conditions in the pulverizer mill.

11. The method according to claim 10, further comprising the step of positioning a thermocouple within the pulverizer mill and operatively connecting the thermocouple to the programmable logic controller and the plurality of nozzle assemblies.

12. A pulverizer mill protection system comprising:

(a) a pulverizer mill comprising a housing;

(b) a supply of a fire suppression solution;

(c) a plurality of nozzle assemblies positioned within the housing and operatively connected to the supply of fire suppression solution, wherein the plurality of nozzle assemblies disperses fire suppression solution within the housing; and (d) a programmable logic controller operatively connected to the plurality of nozzle assemblies, wherein the programmable logic controller is programmed with a plurality of control algorithms instructing each of the nozzle assemblies to disperse suppressant solution at a selected interval, spray pattern and flow range in response to conditions in the pulverizer mill.

13. The pulverizer mill protection system according to claim 12, wherein the pulverize mill comprises:

(a) a classifying element positioned within the housing for classifying the solid fuel, wherein a classifier zone is defined by an area between the classifying element and the upper wall of the mill;

(b) a grinding element positioned within the housing downstream the classifying element for grinding the solid fuel, wherein a grinding zone is defined by an area outside of the classifying element; and (c) a plenum chamber located within the housing below the grinding element where pulverization of coal occurs.

14. The pulverizer mill protection system according to claim 13, wherein the plurality of nozzle assemblies are positioned within the plenum chamber and adapted to disperse the suppression solution within the plenum chamber in a substantially swirling pattern.

15. The pulverizer mill protection system according to claim 14, wherein the housing is substantially cylindrical, and the plurality of nozzle assemblies are positioned in a substantially circular pattern.

16. The pulverizer mill protection system according to claim 14, wherein the plurality of nozzle assemblies spray suppressant solution downwardly at an angle of about forty-five degrees.

17. The pulverizer mill protection system according to claim 16, wherein the plurality of nozzle assemblies spray suppressant solution at a horizontal angle of about forty-five degrees.

18. The pulverizer mill protection system according to claim 13, wherein the the housing comprises a sidewall and a center axis in relation to the sidewall, and further wherein the plurality of nozzle assemblies are adapted to disperse the suppressant solution along a tangent of an annular center line between the sidewall and the center axis.

19. The pulverizer mill protection system according to claim 13, wherein the pulverizer mill comprises a substantially cylindrical housing containing the plenum chamber, the housing having a sidewall surrounding a shaft housing, and further wherein the plurality of nozzle assemblies are adapted to disperse the suppressant solution along a tangent of an annular center line between the sidewall and the shaft housing.

20. The pulverizer mill protection system according to claim 13, wherein the programmable logic controller is operatively connected to a thermocouple adapted for detecting a temperature within the plenum chamber, the programmable logic controller adapted to activate the nozzle assemblies to disperse suppressant solution when the temperature detected by the thermocouple exceeds a predetermined maximum.

* * * * *